US010000054B2

(12) United States Patent
Schumann et al.

(10) Patent No.: US 10,000,054 B2
(45) Date of Patent: Jun. 19, 2018

(54) SHEET-PROCESSING MACHINE HAVING A SHEET-GUIDING DRUM, AND METHOD FOR PRODUCING A GRIPPER SYSTEM

(71) Applicant: KOENIG & BAUER AG, Würzburg (DE)

(72) Inventors: Frank Schumann, Friedewald (DE); Lutz Halbach, Coswig (DE); Christian Ziegenbalg, Weinbohla (DE); Uwe Becker, Radebeul (DE); Jorg Seefeld, Radebeul (DE); Gunter Peter, Radebeul (DE)

(73) Assignee: Koenig & Bauer AG, Wurzburg (DE)

( * ) Notice: Subject to any disclaimer, the term of this patent is extended or adjusted under 35 U.S.C. 154(b) by 0 days. days.

(21) Appl. No.: 15/547,852

(22) PCT Filed: Apr. 20, 2016

(86) PCT No.: PCT/EP2016/058797
§ 371 (c)(1),
(2) Date: Oct. 10, 2017

(87) PCT Pub. No.: WO2016/188678
PCT Pub. Date: Dec. 1, 2016

(65) Prior Publication Data

US 2018/0015715 A1 Jan. 18, 2018

(30) Foreign Application Priority Data

May 27, 2015 (DE) ..... 10 2015 209 696

(51) Int. Cl.
*B65H 5/12* (2006.01)
*B65H 5/14* (2006.01)
(Continued)

(52) U.S. Cl.
CPC ..... *B41F 21/104* (2013.01); *B41F 21/10* (2013.01); *B41F 21/106* (2013.01); *B65H 5/12* (2013.01); *B65H 5/14* (2013.01); *B65H 2801/03* (2013.01)

(58) Field of Classification Search
CPC ... B65H 5/12; B65H 5/14; B41F 21/10; B41F 21/104; B41F 21/106
See application file for complete search history.

(56) References Cited

U.S. PATENT DOCUMENTS 5,588,773 A * 12/1996 Friedrichs ..... B41F 21/104 101/409
6,263,794 B1 * 7/2001 Haupenthal ..... B41F 21/104 101/246
(Continued)

FOREIGN PATENT DOCUMENTS

DE 2414998 A1 10/1975
DE 10225503 A1 1/2004
(Continued)

OTHER PUBLICATIONS

International Search Report of PCT/EP2016/058797 dated Jul. 20, 2016.

*Primary Examiner* — Luis A Gonzalez
(74) *Attorney, Agent, or Firm* — Mattingly & Malur, PC

(57) ABSTRACT

A sheet-guiding drum in a sheet-processing machine, comprises a gripper system, a gripper shaft, and a gripper tube. A method for producing a gripper system is also disclosed. The sheet-guiding drum further improves the sheet transport process, in particular the turning process, in sheet-processing machines. The problem addressed by the invention is in particular the provision of a low-wear rolling-element bearing that preferably eliminates the aforementioned disadvantages and, in particular, meets all further boundary condi-
(Continued)

tions. This problem is solved in that the gripper tube is assembled from tube segments.

15 Claims, 10 Drawing Sheets

(51) Int. Cl.
*B65H 5/08* (2006.01)
*B41F 21/10* (2006.01)

(56) References Cited

U.S. PATENT DOCUMENTS 6,705,227 B2 * 3/2004 Becker ..... B41F 21/04
101/230
7,849,794 B2 * 12/2010 Helmstadter ..... B41F 21/106
101/230

FOREIGN PATENT DOCUMENTS

DE 10350987 A1 6/2005
DE 102005045289 A1 4/2006
GB 1498904 A1 1/1978

* cited by examiner

SHEET-PROCESSING MACHINE HAVING A SHEET-GUIDING DRUM, AND METHOD FOR PRODUCING A GRIPPER SYSTEM

CROSS-REFERENCE TO RELATED APPLICATIONS

This application is the United States National Phase, under 35 U.S.C. § 371, of PCT/EP2016/058797, filed Apr. 20, 2016; published as WO 2016/188678A1 on Dec. 1, 2016, and claiming priority to DE 10 2015 209 696.3, filed May 27, 2015, the disclosures of which are incorporated in their entireties herein by reference.

FIELD OF THE INVENTION

The present invention relates to a sheet-processing machine having a sheet-guiding drum, and to a method for producing a gripper system.

BACKGROUND OF THE INVENTION

A pincer gripper system can comprise a gripper tube, for example, on which preferably spring-mounted pincer halves (strikes) are mounted, and a pincer gripper shaft, which is mounted coaxially, in particular, inside said gripper tube. Fixed pincer halves (tongues) can be screw-mounted on the pincer gripper shaft. Due to space considerations, it is customary to mount the pincer gripper shaft using space-saving sliding bearing sleeves, which are adhesively bonded into the gripper tube or onto the pincer gripper shaft. The bearing points of the gripper tube that are located at the same positions are also typically formed using sliding bearing sleeves, to keep the bearing points from protruding too far out of the drum body.

Known from DE-OS 2414998 is a turning device for a perfecting printing machine having pincer grippers, in which the pincer gripper shaft is mounted in sliding bearings.

DE 10 2005 045289 A1 discloses a sliding surface mounting, in which the pincer gripper shaft is mounted over a cast resin bearing surface.

It is a disadvantage that adequate functional clearance and sufficient lubricant are extremely critical for the functioning of the sliding bearing arrangement. Any deformation of the coaxial shafts or insufficient lubrication can result in increased wear on the bearing.

DE 103 50 987 A1 discloses a gripper system in a sheet-guiding cylinder of a sheet-fed rotary printing machine, in which a gripper shaft is mounted rotatably directly on the sheet-guiding cylinder, and a swinger shaft is composed of gripper boxes, rotatably mounted separately on the gripper shaft. The disadvantage of this solution is that the gripper shaft is still mounted on a plurality of bearing supports of the cylinder. The swinger shaft composed of gripper boxes thus has a complex construction.

With pincer gripper systems, the space conditions are too tight for known rolling bearing arrangements. Furthermore, the hardened raceways that are required cannot be produced within the necessary form and position tolerances.

SUMMARY OF THE INVENTION

The object of the present invention is therefore to further improve the transport process, in particular the turning process, in sheet-processing machines. More particularly, the object of the invention is to construct a low-wear rolling bearing arrangement that preferably overcomes the aforementioned disadvantages and, in particular, satisfies all other constraints.

The object is achieved according to the invention by the provision of a sheet-processing machine having a sheet-guiding drum in which the sheet-guiding drum has a gripper system comprising a gripper shaft and a gripper tube. The gripper tube is composed of a joined tube section and the gripper tube is mounted rotatably on its outer lateral surface. A method is provided for producing a gripper system for a sheet-guiding drum of a sheet-processing machine. A gripper shaft in a gripper tube are provided. The gripper tube is composed of joined tube segments. Gripper elements are allocated to the gripper shaft via recesses in the gripper tube, once the tube segments have been connected to form the gripper tube.

The invention offers the advantage that the transport process, in particular the turning process, in sheet-processing machines is further improved.

In one embodiment, a sheet-guiding drum is used, which supports at least one gripper system. The sheet-guiding drum is used for guiding or transporting or conveying a sheet-type substrate, in particular a sheet, by rotational movement. The sheet-guiding drum can further comprise at least casing segments, which may be embodied as rigid or as movable. As a further refinement, the sheet-guiding drum may also be embodied as a cylinder, with a cylinder typically comprising at least casing segments or having a continuous lateral surface. The sheet-guiding drum or a cylinder can be configured as single-sized, double-sized or multi-sized; a single-sized drum or a single-sized cylinder can have precisely one gripper system or can guide precisely one maximum-format sheet on its circumferential surface. Double-sized or multi-sized drums or cylinders have two or more gripper systems or can hold two or more sheets on their circumferential surface, accordingly.

In one embodiment, a sheet-guiding drum is provided with at least one middle casing segment, which is preferably arranged axially across the width of the drum between sheet-supporting surfaces of additional casing segments. The middle casing segment is preferably mounted coaxially to the drum and/or can be moved in or opposite the circumferential direction of the drum. The middle casing segment can have a plurality of sheet-supporting surfaces, spaced from one another. Each sheet-supporting surface can be mounted individually on the drum axis, for example, or a plurality of sheet-supporting surfaces can be assigned to a common carrier, for example a cross-member, which is preferably mounted or guided coaxially to the sheet-guiding drum. The sheet-supporting surfaces of the middle casing segment can be mounted on the drum body individually, in groups, or collectively, in particular, via bearing washers. The sheet-supporting surfaces of the middle casing segment, along with sheet-supporting surfaces of segment teeth or additional supporting surfaces of the additional casing segments, form the periphery of the sheet-guiding drum. In particular, an at least partially cylindrical or drum-shaped lateral surface is formed by the at least three cooperating casing segments, which can be adjusted relative to one another. The segment teeth or sheet-supporting surfaces of the cooperating casing segments engage with one another during format adjustment or format setting, and in the minimum format, all the segment teeth of the casing segments and the sheet-supporting surfaces of the middle casing segment preferably lie side by side. In the circumferential direction, the sheet-supporting surface further comprises gripper arms of a gripper system or suction systems, for example rotary suckers, for sheet trailing edges.

The meshing regions of a sheet-supporting surface are formed by sheet-supporting surfaces sliding along one another in the circumferential direction of the sheet-guiding drum. For this purpose, a leading casing segment preferably has segment teeth or consists of segment teeth, each of which has a sheet-supporting surface and, in the axial direction, lateral faces. A trailing casing segment preferably likewise has segment teeth or consists of segment teeth, each of which has a sheet-supporting surface and, in the axial direction, lateral faces. A middle casing segment, located between the leading casing segment and the trailing casing segment in the circumferential direction, preferably likewise has sheet-supporting surfaces, each of which has lateral faces in the axial direction. During format setting or format adjustment, the lateral faces of the leading segment teeth slide along in the circumferential direction against the lateral faces of the sheet-supporting surfaces of the middle casing segment, and/or the lateral faces of the sheet-supporting surfaces of the middle casing segment slide along against the lateral faces of the segment teeth of the trailing casing segment. The region that can be formed by lateral faces of the casing segments sliding along against one another is the meshing region of a sheet-supporting surface of the sheet-guiding drum. The lateral faces of the sheet-supporting surface of the middle casing segment, or of the segment teeth, preferably slide at a minimal distance from one another or are preferably spaced a technologically determined minimal distance from one another in the axial direction.

The middle casing segment can be driven by means of a separate drive mechanism, for example an independent drive mechanism. Advantageously, however, the middle casing segment is driven by slaving to adjustable elements of the sheet-guiding drum. Preferably, the middle casing segment is driven by slaving to the format-adjustable casing segment, in particular to the suction systems thereof, preferably to suckers for perfecting cylinders, in other words, no auxiliary drive mechanism is required. Thus the drive mechanism preferably effects a joint adjustment of the format-adjustable casing segment and the middle casing segment. In a further refinement, a plurality of bridging elements having sheet-supporting surfaces and arranged side by side are fixedly connected to a cross-member which is mounted on the arm of the drum body, for example a storage drum body. The cross-member is preferably adjusted without slip by the drive mechanism of the format-adjustable trailing casing segment, in particular the format-adjustable suction systems, preferably by rotary suckers. In this case, the cross-member can be driven via transmission gearing. The transmission gearing can be embodied, for example, as stationary gearing or as planetary gearing. In particular, the middle casing segment is moved along with the format adjusting movement of the format-adjustable casing segment. The cross-member then moves, for example, by a fraction of the adjustment angle of the additional casing segment. Stop elements may also be provided for the movable elements, particularly in the minimum format and/or the maximum format.

In a preferred embodiment, a sheet-guiding drum, in particular a storage drum, is provided, which comprises the at least one centrally mounted middle casing segment, in particular a plurality of bridging elements that have sheet-supporting surfaces, and offers a defined format adjustment without an additional drive mechanism. Such a centered bearing of the middle casing segment is easy to produce and is thus advantageous. As a further advantage, a precise and smoothly running bearing for the middle casing segment is produced. Further advantageous is the specified slip-free movement of the middle casing segment, which further increases the safety of the machine. In the case of multiple-sized sheet-guiding drums, middle casing segments and other casing segments can be provided in corresponding multiple sizes.

In a preferred embodiment, the casing segments for the leading and trailing edges are embodied as shorter than is required for the maximum sheet format, by approximately the length of the middle casing segment, in particular by the circumferential extension of the sheet-supporting surfaces or by the circumferential extension of the bridging elements. This results in an enlarged functional surface in the circumferential direction on the fixed casing segment and/or preferably on the format-adjustable casing segment, in particular the casing segment for the trailing portion of a sheet, beyond the meshing region of the segment teeth; this functional surface can also be utilized over the full drum width or sheet width for auxiliary functions. For example, the enlarged functional surface that is produced may be used for pneumatic elements and/or for mechanical elements. Advantageously, the functional surface is enlarged substantially for the arrangement of pneumatic operating elements on the periphery of the sheet-guiding drum, in particular the storage drum, without restriction of the maximum and minimum format length. This substantially enlarged functional surface is particularly advantageous for the positioning of pneumatic operating elements on the periphery of a storage drum, and is also suitable for mechanical elements. Thus, a functional surface that is uninterrupted across the format width can be provided.

The sheet-guiding drum is preferably embodied as a storage drum, and more preferably is used in a three-drum turning device of a sheet-fed printing press, for example. In a further refinement, the sheet-guiding drum, in particular embodied as a storage drum, can be assigned a separation device (guide blade), which guides the sheet to a different path or expands the storage capacity. If such a storage drum is not equipped with grooves for the blade to dip into, the leading edge of the sheet can be raised a certain amount by means of knock-out pins, so that the sheet can be guided reliably onto the blade unit.

In one embodiment, a sheet-guiding element is installed in at least one gripper channel of a sheet-guiding drum, for pneumatically guiding the sheets in a turning device, for example. A switching means for selectively activating the sheet-guiding element, in particular a deflector plate, or an additional pneumatic element, in particular a suction system, of the sheet-guiding drum is preferably provided in the gripper channel of the sheet-guiding drum. The switching means may be embodied as a control valve, for example. Particularly preferably, the switching means is configured as a pivoting slide valve, which is moved by means of an actuating lever of a drive mechanism, for example a four-bar linkage, of the controlled deflector plate, and thereby activates the suction air before the slide valve reaches its operating position. The pivoting slide valve preferably has at least two operating positions for supplying suction air to at least two pneumatic operating elements. In a further refinement, one or more additional pneumatic elements can also be integrated individually or in groups.

Existing suction air supplies to at least one additional pneumatic element, in particular to suction systems of the sheet-guiding drum, for example to trailing edge perfecting cylinder suckers, suction openings in the lateral surface and/or pneumatic grooves in the lateral surface or the segment teeth, are preferably reversed by the switching means, for example, and are then used to supply suction air to the sheet-guiding element in the gripper channel, in particular the preferably controlled deflector plate. Advantageously, no additional air supply is required for this purpose. A quasi-automatic control of the supply of air is thereby possible. Particularly preferably, a sheet-guiding element, for example the deflector plate, in the gripper channel is provided with an optimal length, which further improves sheet guidance in a turning device. In this way, in the circumferential direction, the sheet-guiding element can overlap the gripper system in the channel in the circumferential direction. The sheet-guiding element can likewise be adapted to the periphery of the sheet-guiding drum.

In a further refinement, the two alternatingly activated air supplies can also be supplied with air from two different air generators, through a combination with a rotary valve in the direction of the air generators. Different pressure and/or suction air levels are thus possible. For example, the suction systems of the sheet-guiding drum can be operated at a first pressure or suction air level, and the deflector plate can be operated at a pressure or suction air level that is higher or lower than the first pressure or suction air level. Alternatively, the sheet-guiding element and the additional element can also be supplied jointly with blast air. As a further alternative, a combination of connected suction air and blast air can be realized. Alternatively, however, the sheet-guiding drum with the sheet-guiding element in the gripper channel and with the additional pneumatic element can be used outside of the turning device in the sheet-processing machine.

The movement of the sheet-guiding element is preferably controlled by means of a drive mechanism, in particular by means of a multi-linkage mechanism, preferably by means of a coupler mechanism, particularly preferably by means of a four-bar linkage. Using such a four-bar linkage as a drive mechanism, as opposed to a mere pivoting movement, enables the sheet-guiding element to be maintained in its precise operating position, and also to be guided into its precise parked position. As a result, the sheet-guiding element can span nearly the entire gripper channel when a maximum format is set. Thus the sheet-guiding element can nearly completely cover the gripper channel across the width of the drum and/or in the circumferential direction of the drum.

In a further embodiment, a separation device is associated with a sheet-guiding drum. In this case, the leading sheet edge is advantageously lifted away from the lateral surface of the sheet-guiding drum, with the height and the separation of the entire sheet being determined by the adhesive forces being applied and by the "flight characteristics". The sheet is guided as far as possible on the sheet-guiding drum, thereby facilitating the jump to the separation device. In a further refinement, the separation device is embodied as a blade unit that operates with an aspirating or suctioning action. Advantageously, the sheets are guided onto the blade unit in a defined manner by simple means. The sheet-guiding drum can preferably be embodied as a storage drum in a turning device or, in a further refinement, as a cylinder, for example as an impression cylinder.

The sheets are particularly preferably held in a defined manner on the sheet-guiding drum at their leading portion, while a defined free length of the sheet leading edge is lifted away. The forces for holding the leading portion of a sheet on the sheet-guiding drum are generated, for example, by suction openings (or by suctioning blast air nozzles) in a region downstream of the grippers. Said openings are arranged, for example, in the casing segments (or segment teeth) of the gripper system and/or in a monolithic region. For a monolithic region, it is advantageous for the described suction device to form a continuous strip transversely to the direction of travel, which improves a hinging action as compared with merely a point-wise action. A monolithic region can be formed, for example, by an additional functional surface on a storage drum.

Once the sheet has been straightened and secured at its trailing edge on the storage drum by means of the suction system, it can be released at its leading edge by the gripper system. At the same time or slightly earlier, the suction air for the suction openings is activated. The knockout element lifts the sheet leading edge away, preferably only over a length which is defined by the arrangement of the suction openings, that is, by the distance from the knockout element. In a further refinement, diminishing suction may be formed (in particular, if multiple suction devices are disposed one behind the other). The suction is preferably applied until the guide blade has taken over guidance of the sheet leading edge. Improved sheet guidance is thereby achieved with a simple structure. The sheets can be held in a defined manner during turning, in particular during the blade process. Further, the sheets can be received directly from the blade device without the sheets having to jump from a greater distance.

In one embodiment, a pincer gripper system is used, which comprises a gripper tube and a pincer gripper shaft mounted coaxially within the gripper tube; the gripper tube may comprise a plurality of interconnected tube segments. The gripper tube preferably comprises at least two or more tube segments. Particularly preferably, such tube segments can be arranged side by side across the width of the drum, indirectly connected via connectors. To enable the pincer gripper shaft to be mounted rotatably inside the gripper tube, the pincer gripper shaft is equipped with at least one, and preferably with multiple recessed raceways. The recessed raceways are used for mounting the pincer gripper shaft coaxially to the gripper tube. The recessed raceway may be a shaft section that has a smaller diameter than the adjacent shaft sections. The shaft section of the recessed raceway and/or of the adjacent shaft sections is, in particular, circular in cross-section.

It is further provided that the gripper shaft arranged inside the gripper tube, in particular the pincer gripper shaft, is formed with a slotted needle roller and cage assembly in the at least one recessed raceway. The slotted needle roller and cage assembly is a rim or cage that accommodates needle rollers and that can be opened up at least at one point. When the slotted needle roller and cage assembly is opened, the needle rollers that are held adjacent to the opening point are correspondingly moved apart. The opening can be used for assembly at the location of the recessed raceway in the gripper shaft, in particular the pincer gripper shaft, preferably by sliding elements on axially. In a further refinement, the needle rollers of the slotted needle roller and cage assembly cooperate with a hardened bearing surface, for example a hardened bearing ring. The hardened bearing surface can be located in the region of the slotted needle roller and cage assembly between the needle rollers and the gripper tube.

Slotted needle roller and cage assemblies are preferably arranged in multiple or in all of the recessed raceways of the gripper shaft, in particular the pincer gripper shaft. The outer gripper tube that surrounds the pincer gripper shaft is thus preferably subdivided into a plurality of tube segments. The tube segments are preferably divided at or near the slotted needle roller and cage assemblies, resulting in shorter sections that can be more easily produced. In particular, it is an advantage that heat treatment is not necessary for producing the gripper tube from the tube segments. In a preferred refinement, the tube segments are connected by means of connectors, for example sleeve couplings. These connectors particularly preferably include the hardened raceways for the slotted needle roller and cage assemblies; short pieces experience less heat distortion during hardening, and therefore thorough hardening is possible. In a further preferred refinement, the tube segments and the connectors are materially bonded, for example by joining and/or gluing, and/or are connected by a force-fitting connection, for example by shrink fitting.

Such a roller bearing arrangement of the pincer gripper system is a wear-resistant bearing arrangement, and as such is advantageously robust and unsusceptible to poor maintenance. Also advantageously, although the possibilities for assembling such arrangements may be maximized, they cannot be exceeded due to the avoidance of very long tubes. The pincer gripper system is preferably used in a turning drum of a sheet-processing machine, for example a printing machine. The turning drum may be part of a turning device, for example a one-drum turning unit, or preferably a three-drum turning unit. The three-drum turning unit can comprise a single-sized or double-sized transfer drum, for example, preferably a double-sized storage drum, and the turning drum, and the storage drum can have two or more format-adjustable casing segments per casing half. It is particularly preferable for the turning drum to be single-sized, with just one pincer gripper system being assigned to a single-sized turning drum. However, the turning drum may also be embodied as double-sized or multi-sized, accordingly with two or more pincer gripper systems, which are distributed uniformly over the circumference of the drum. The radius from the rotational axis of the turning drum to the lateral surface of the turning drum can also be smaller than the radius from the rotational axis to the pincer gripper system.

Another embodiment provides for the formation of a transfer gripper system for a turning drum of a sheet-processing machine, comprising a gripper shaft that has at least one recessed raceway. A slotted needle roller and cage assembly is preferably inserted into the recessed raceway. The transfer gripper system in this case has two correlating gripper systems, one of which captures a sheet trailing edge in the perfecting printing mode, and transfers this edge to the other gripper system in an internal transfer as the rotation of the turning drum continues. The other gripper system then transfers what is now the leading edge of the sheet to the sheet transport system downstream.

In the following, the invention will be explained in detail by way of example. The accompanying drawings schematically illustrate:

DESCRIPTION OF THE PREFERRED EMBODIMENTS

Figure 1:
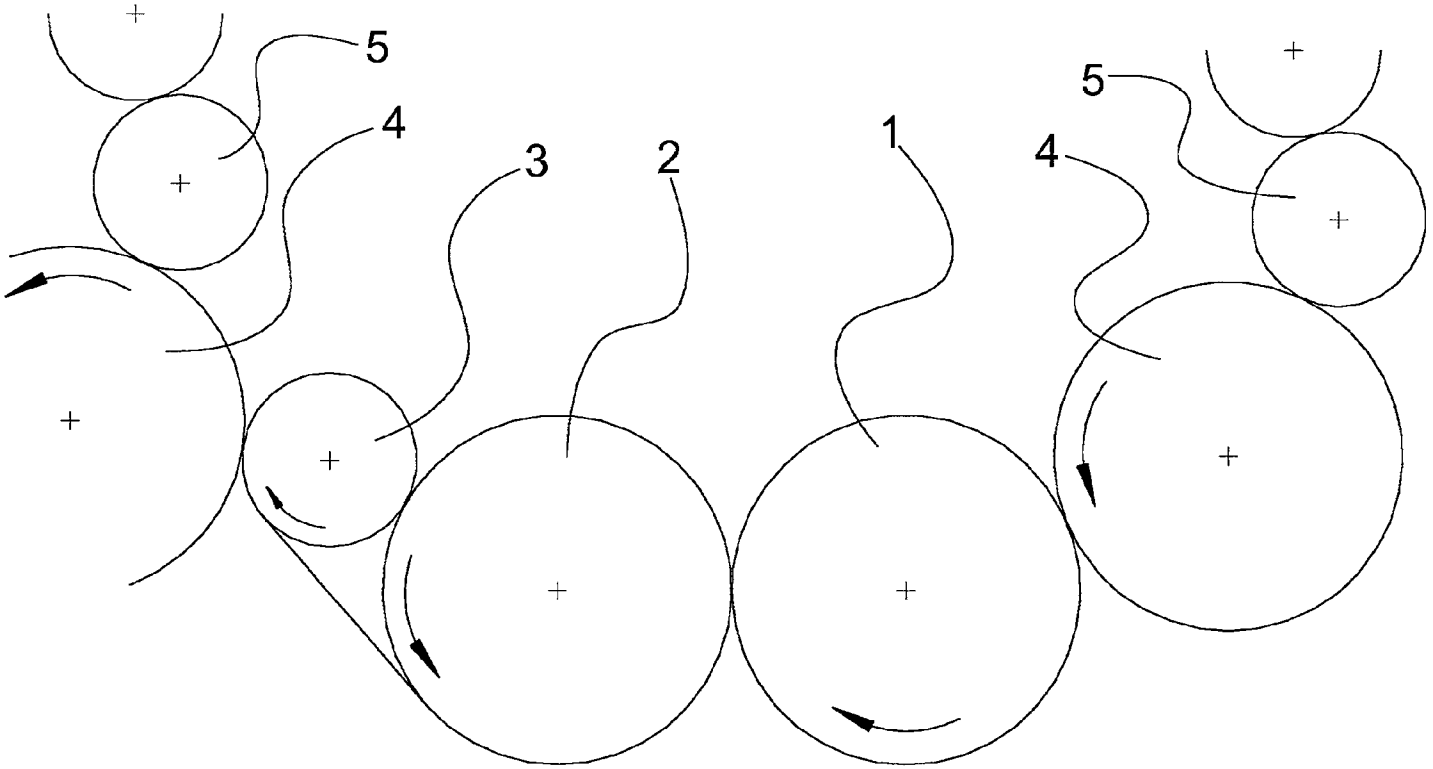
FIG. 1: a turning device for a sheet-processing machine.

FIG. 1 shows one embodiment of a portion of a sheet-processing machine, for example a sheet-fed printing machine, in particular a sheet-fed rotary offset printing machine, preferably configured based on the unit construction principle and having a turning device. The machine contains at least two units arranged in succession, which may be embodied as feeding, printing, varnishing, drying or finishing units, for example. The machine may further include a feeder for sheet feeding and a delivery unit for delivering the processed sheets. The turning device is arranged between two units of the machine, with the turning device having at least one sheet-guiding system by means of which at least one of the sheets can be turned. Preferably, the turning device turns one of a number of sheets transported in sequence.

In this case, the turning device is arranged between one cylinder, for example a printing cylinder 4, of an upstream unit, in particular a printing unit, and another cylinder, for example a printing cylinder 4, and of a downstream unit, in particular a printing unit, of the machine. The printing cylinders 4 have continuous lateral surfaces, and in this case are operatively connected to rubber blanket cylinders 5, which are in turn operatively connected to plate cylinders in the printing units. Known inking or inking and dampening units (not shown), which apply the appropriate printing ink to printing plates that are clamped to the respective plate cylinders, are arranged in the printing units. Each plate cylinder is inked up during its rotation by means of at least one, but preferably by a plurality of rollers of the associated inking or inking and dampening unit. As the plate cylinder rolls against rubber blanket cylinder 5, the printing ink is transferred suitably for the matter to be printed to rubber blanket cylinder 5, which is covered with a rubber printing blanket. Between rubber blanket cylinder 5 and printing cylinder 4, a printing zone is formed, through which the sheet to be printed is conveyed by printing cylinder 4. In the printing zone or in the press nip, the printing ink is transferred from the rubber blanket cylinder 5 to the sheet in a manner suitable for the matter to be printed. Rubber blanket cylinders 5 and plate cylinders may be embodied as single-sized, for example. Alternatively or additionally, a turning device may also be arranged between other units in the machine.

The machine includes sheet conveyor systems, in particular sheet-guiding cylinders and/or sheet-guiding drums, for transporting the sheets through the units. In the units, for example printing units, and in the turning device, in particular sheet-guiding cylinders and sheet-guiding drums are arranged, which preferably have gripper systems 6 for securing the sheets for sheet transport. Here, the gripper systems 6 are embodied as pincer grippers for clamping onto the sheet leading edge. The printing cylinders 4 may be embodied as double-sized, for example, and during their rotation they may transport the sheets to be printed through the printing zone or the printing unit. For transport, the sheets are gripped and thereby secured at their leading edge by means of gripper systems 6. Between two printing cylinders 4, the sheets can be transported and transferred by at least one sheet conveyor system. For example, one sheet-guiding drum or a plurality of sheet-guiding drums or sheet-guiding cylinders may be provided between the printing cylinders 4. The sheet-guiding drums or sheet-guiding cylinders may be embodied as single-sized or multi-sized. For sheet transport, the sheet-guiding cylinder(s) may have a continuous lateral surface or at least lateral surface segments onto which the sheets are fed. Sheet-guiding drums may also have a lateral surface or at least lateral surface segments, which can also be movably assigned to the drum. Caps, which may be embodied as movable and/or removable, for example, can also be assigned to the sheet-guiding drums. Alternatively, however, sheet-guiding drums may also be embodied as "transferters", without lateral surface segments. Between the sheet-guiding cylinders, in particular printing cylinders 4, and/or the sheet-guiding drums, the sheets are transferred at their leading edge in the gripping closure. Additional sheet-guiding elements, such as sheet-guiding plates, for example, may be allocated to the sheet-guiding systems for the purpose of sheet guidance.

In one embodiment, the sheet-guiding drums or sheet-guiding cylinders are rotationally driven by a train of gears in a continuous gear train. The continuous gear train may be driven by a single main drive mechanism, or alternatively by multiple individual motors coupled in at different points. In a further embodiment, however, it is also possible for cylinders, drums and/or rollers to be driven individually or in groups. Preferably, for example, an individual drive mechanism may be assigned to a plate cylinder, which drives the plate cylinder during production printing individually and/or independently of the gear train of the machine. The individual drive for the plate cylinder can be embodied, in particular, as a direct drive, having a directly connected rotor, for example, arranged concentrically to the cylinder axis. In the turning device, the driven cylinders or drums shown here rotate in the direction indicated by the arrows.

The turning device is particularly preferably embodied as a three-drum turner and comprises three sheet-guiding drums for transporting sheets. The turning device comprises, for example, a transfer drum 1, a storage drum 2 and a turning drum 3. Transfer drum 1 is arranged immediately upstream of storage drum 2, and turning drum 3 is arranged immediately downstream of storage drum 2. The machine is preferably embodied as switchable between the front-side printing mode and the perfecting printing mode. In the front-side printing mode, the sheets can be transferred between the sheet-guiding cylinders and sheet-guiding drums without turning. In the perfecting printing mode, the sheets are turned by the turning device, so that in the subsequent printing unit the back side of the sheet can be processed, in particular printed. Intermediate dryers and/or measuring systems (not shown) may be assigned to the turning device.

Both transfer drum 1 and storage drum 2 are embodied as double-sized in this case. The double-sized drums each have two gripper systems 6, located diametrically opposite one another in gripper channels, for the purpose of transporting the sheets at the leading edge thereof. Each of the gripper channels extends across the width of the drum and has an opening in the lateral surface. A gripper system 6 arranged in a gripper channel preferably comprises a gripper shaft, which extends across the width of the drum and on which gripper fingers are fixedly arranged, spaced from one another. When the gripper shaft is pivoted, the gripper fingers form a clamping nip with individual gripper strikes or with a continuous gripper strike rail. Alternatively, however, transfer drum 1 may also be embodied as single-sized. In a further alternative embodiment, the drums may also be embodied as multi-sized.

Turning drum 3 in this case is embodied as single-sized and comprises grippers for receiving a sheet from storage drum 2, at the leading edge thereof in front-side printing and at the trailing edge thereof in perfecting printing. The grippers of turning drum 3 may include pivotable grippers and/or suckers or a pincer gripper system. The transfer of a sheet from storage drum 2 to turning drum 3 takes place at a central transfer point. The central transfer point formed between the two drums is an imaginary line along which a sheet held by storage drum 2 is received by the gripper or grippers of turning drum 3. The sheet is transferred true-to-register while the sheet is held briefly by both drums. Alternatively, however, the turning drum 3 may also be embodied as double-sized or multi-sized, with a single-sized drum or a single-sized cylinder generally accommodating one sheet of maximum format on its peripheral surface. Of course, other drum or cylinder sizes and/or a different number of drums or cylinders may also be used in the units, for example the printing units, and the turning device. Double-sized or multi-sized drums or cylinders are accordingly able to accommodate two or more maximum-format sheets simultaneously on their peripheral surface.

In the turning device, in the perfecting printing mode, the sheet to be turned is guided with its leading edge up to storage drum 2. During turning, the sheet is advanced past storage drum 2 at the central transfer point and is captured at its trailing edge by turning drum 3. In this step, the trailing edge of the sheet lying on storage drum 2 is picked up by the gripper, in particular by a pincer gripper or by grippers and/or suckers, which are mounted pivotably in the rotating turning drum 3. As the rotation of turning drum 3 continues, the captured sheet is then turned according to the principle of trailing edge turning, so that when its movement is reversed, what was formerly its trailing edge becomes its new leading edge, and what was formerly its leading edge lying on storage drum 2 becomes its new trailing edge.

Figure 2:
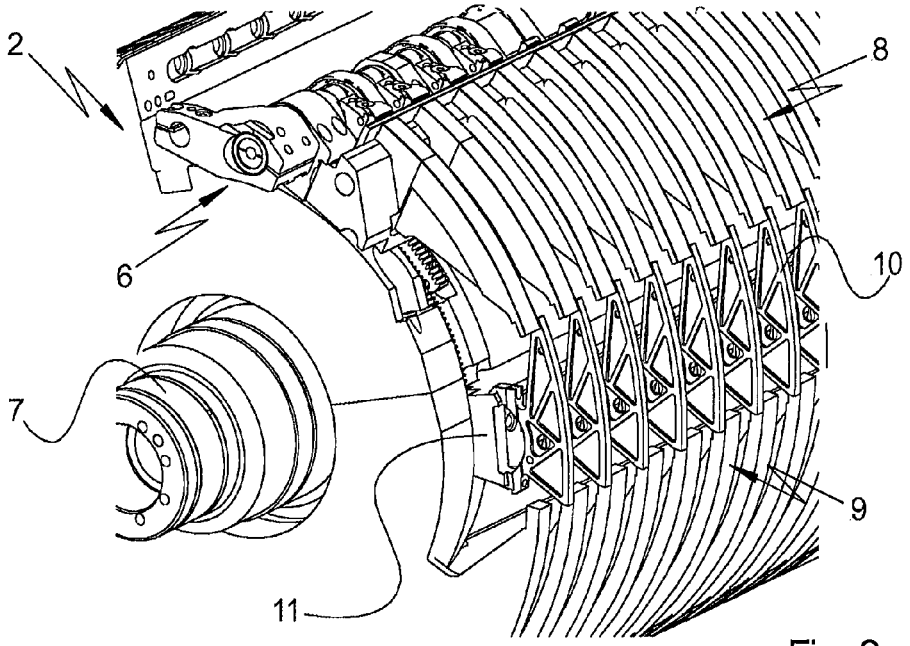
FIG. 2: a perspective view of a storage drum.

FIG. 2 shows a section of a double-sized storage drum 2 from a perspective view. Storage drum 2 is mounted rotatably at both ends in side frames of the machine by means of a storage drum arm 7. A gripper system 6 arranged in one of the gripper channels is shown here. Gripper system 6 in this case comprises a gripper shaft, which is mounted in bearing supports and to which the gripper fingers are fixedly allocated across the width of the drum. The gripper shaft is driven by at least one roller lever via a cam follower and cam disk (not shown). Gripper system 6 is arranged on a leading casing segment which supports the leading portion of a sheet that is clamped by gripper system 6. The leading casing segment is preferably fixedly connected to storage drum arm 7. The leading casing segment is referred to here as the gripper casing segment 8.

Spaced from the leading casing segment in the circumferential direction of storage drum 2, a trailing casing segment is provided, which supports the trailing portion of a sheet that is clamped by gripper system 6. The trailing casing segment is embodied as displaceable relative to storage drum arm 7 in the circumferential direction of storage drum 2, so that sheets of different formats can be supported both by the leading casing segment and by the trailing casing segment. The trailing casing segment is preferably embodied as format-adjustable in that segment teeth of the casing segments engage with one another in a meshing fashion, thereby forming a lateral surface that will support a sheet. The two diametrically opposite trailing casing segments of the double-sized storage drum 2 are preferably moved jointly in relation to the fixed leading casing segments for the purpose of format adjustment. A common drive mechanism or synchronized drive mechanisms may be used for this purpose.

In a further refinement, suction systems, in this case rotary suckers 17 in particular, are provided on the trailing casing segments that can be displaced relative to the leading casing segments, for the purpose of picking up and guiding the sheet trailing edges. Rotary suckers 17 can be used for straightening the sheets longitudinally and/or transversely during their transport from transfer drum 1 to turning drum 3, while they are lying on storage drum 2 and/or, in perfecting printing, downstream of the central transfer point. In the area around the central transfer point between storage drum 2 and turning drum 3, the supply of suction air to rotary suckers 17 is preferably reduced, and in perfecting printing is particularly preferably interrupted, to enable the grippers of turning drum 3 to pick up the trailing edge of the sheet and in particular to separate it from storage drum 2. The trailing casing segment in this case is referred to as the sucker casing segment 9.

The circumferential extensions of a leading casing segment and of the corresponding trailing casing segment are preferably configured such that their combined measurement is smaller than the maximum sheet length. A sheet of the maximum format thus overlaps overall the leading and trailing casing segments including segment teeth in the circumferential direction. For sheet guidance, storage drum 2 contains at least one middle casing segment, which is arranged between the leading casing segment and the trailing casing segment in the circumferential direction. In the double-sized embodiment here, storage drum 2 comprises exactly two middle casing segments, each of which cooperates with the other casing segments of the two casing halves. In particular, storage drum 2 here comprises a plurality of bridging elements 10 across the drum width, which form the middle casing segment and have sheet-supporting surfaces, and which can be positioned at least intermittently between a leading casing segment and the corresponding trailing casing segment. Bridging elements 10 are arranged between the leading casing segment and the corresponding trailing casing segment in the circumferential direction. The sheet-supporting segments for the leading and trailing edges (gripper casing segment 8 and sucker casing segment 9) are configured here as shortened in the circumferential direction, approximately by the circumferential extension of bridging elements 10. In this case, bridging elements 10 are arranged with uniform spacing from one another and have a narrow axial extension with respect to storage drum 2.

The middle casing segment, in particular bridging elements 10, is arranged across the drum width between the segment teeth of the leading and/or trailing casing segment. In this case, the middle casing segment, in particular bridging elements 10, has no mechanical connection to the segment teeth of gripper casing segment 8 and/or of sucker casing segment 9 in the region of its sheet-supporting surfaces. The sheet-supporting surfaces of the middle casing segment, in particular of bridging elements 10, are preferably located immediately adjacent to segment teeth of gripper casing segment 8 and/or immediately adjacent to segment teeth of sucker casing segment 9. Particularly preferably, bridging elements 10 are configured such that they can be positioned entirely between the segment teeth of gripper casing segment 8 and the segment teeth of sucker casing segment 9. Bridging elements 10 are further configured such that, together with gripper casing segment 8 and sucker casing segment 9, they form a sheet-supporting surface for every sheet format. A leading casing segment, in particular gripper casing segment 8, the bridging elements 10 of the middle casing segment, and the trailing casing segment, in particular sucker casing segment 9, together form a sheet-supporting surface for sheets of the respective sheet format. Sucker casing segment 9 is preferably always positioned in relation to the sheet trailing edge in such a way that the sheet trailing edge can be secured, in particular, by the rotary suckers 17 of sucker casing segment 9, regardless of the sheet format.

Bridging elements 10 are preferably arranged axially between the segment teeth of gripper casing segment 8 and sucker casing segment 9 such that one segment tooth of gripper casing segment 8 and one segment tooth of sucker casing segment 9 is assigned to each bridging element 10. Particularly preferably, each bridging element 10 has exactly one segment tooth of gripper casing segment 8 positioned immediately adjacent to it in the longitudinal direction on one side, and exactly one segment tooth of sucker casing segment 9 positioned immediately adjacent to it on the opposite side. More preferably, bridging elements 10 are preferably configured such that, when positioned for the maximum sheet format, an overlap in the circumferential direction of segment teeth of gripper casing segment 8, segment teeth of sucker casing segment 9, and bridging elements 10 is created.

Bridging elements 10 can be mounted individually, in groups, or collectively on the drum axis of storage drum 2. Bridging elements 10 are preferably assigned collectively to a cross-member 11, in particular a profiled middle cross-member 11. This cross-member 11 is preferably configured such that, when the minimum format is set, there is space for the cross-member between gripper casing segment 8 and sucker casing segment 9. In particular, the segment teeth of gripper casing segment 8 and/or sucker casing segment 9 project beyond cross-member 11 when the minimum format is set. If bridging elements 10 are mounted individually or in groups, they can also be moved and/or driven individually or in groups. Preferably, however, bridging elements 10 are driven collectively via the common cross-member 11. Cross-member 11, which extends across the width of the drum, is mounted movably in the circumferential direction of storage drum 2. Cross-member 11 is preferably connected in the lateral drum region to bearing washers, which are mounted on the drum body of storage drum 2. The bearing washers can be mounted adjacent to the bearing of the adjustable casing segment, for example, on the inside next to the bearing points of sucker casing segment 9. Particularly preferably, the bearing washers are mounted coaxially to the rotational axis of storage drum 2, so that the sheet-supporting surfaces of bridging elements 10 are aligned precisely in a cylindrical shape or a drum shape in every position.

Figure 3:
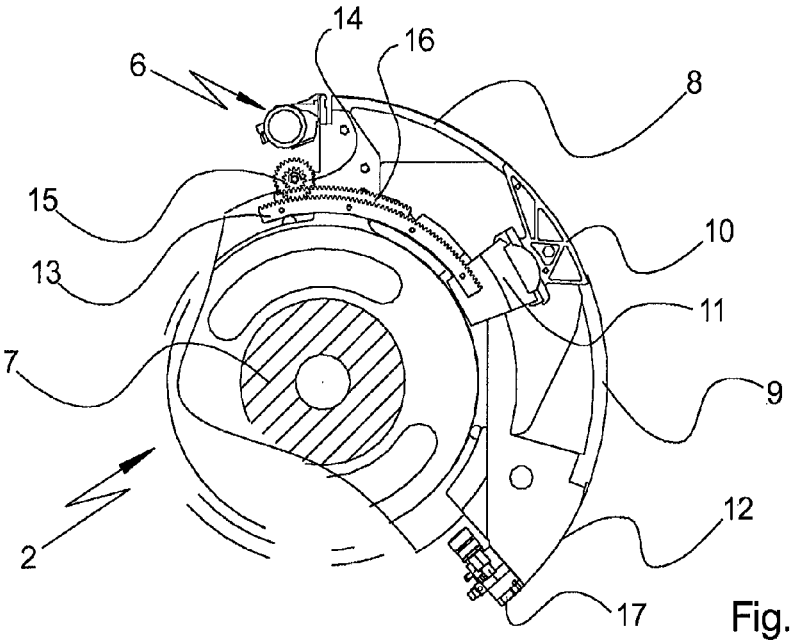
FIG. 3: the drive mechanism of the middle casing segment of the storage drum.

FIG. 3 shows the drive mechanism of the bridging elements 10 of storage drum 2, in particular for the purpose of format adjustment. Cross-member 11 that supports bridging elements 10 can be driven by means of transmission gearing.

For example, when sucker casing segment 9 moves relative to gripper casing segment 8, a toothed segment 13 can be moved along as a drive mechanism. This toothed segment 13 can be permanently assigned to sucker casing segment 9. The toothed segment 13, which is moved along with sucker casing segment 9, can further mesh with a stepped pinion, for example a gear wheel 14 and a gear wheel 15, which then moves cross-member 11 by a fraction of the adjustment angle of sucker casing segment 9, for example by approximately one-half. In the embodiment shown, gear wheel 14 meshes with toothed segment 13 and gear wheel 15, which is connected in particular fixedly to gear wheel 14, meshes with a toothed segment 16. The gear wheel pair 14/15 transmits the movement introduced by toothed segment 13 of sucker casing segment 9, in a preselectable gearing ratio that is not equal to one, to toothed segment 16, which is in turn fixedly connected to cross-member 11 that supports the bridging elements 10. A drive mechanism of this type can preferably be provided on both sides of storage drum 2. Alternatively, however, the drive mechanism could also be embodied as planetary gearing. As a further alternative, the drive mechanism can also be derived directly from the drive mechanism of the movable casing segment, in this case sucker casing segment 9, or the drive mechanism can be assigned to the middle casing segment, and movement can be transmitted to the format-adjustable casing segment, for example sucker casing segment 9.

Gripper casing segment 8, including the segment teeth, can extend, for example, from gripper system 6 in the circumferential direction of storage drum 2 over a radius or rotation angle of approximately 40°. The gripper strikes of gripper system 6 likewise form part of the sheet-supporting surface, but may be arranged in the gripper channel adjacent to gripper casing segment 8. The gripper strikes of gripper system 6 can be permanently assigned or connected to gripper casing segment 8. For example, bridging elements 10 can extend from their leading edge to their trailing edge over a circumferential range or radius of approximately 32°. The segment teeth of sucker casing segment 9 can extend up to the system of suckers, in particular rotary suckers 17, for example over a circumferential range or radius of approximately 40°. The sucker system, in particular the rotary suckers 17, likewise form part of the sheet-supporting surface, but are likewise preferably located in the gripper channel arranged adjacent to sucker casing segment 9. The sucker system, in particular the rotary suckers 17, are thus permanently assigned to sucker casing segment 9. In the maximum format, the bridging elements 10 might also overlap in the circumferential direction with the segment teeth of gripper casing segment 8 and/or sucker casing segment 9. In the minimum format, the bridging elements 10 preferably lie completely between the segment teeth of gripper casing segment 8 and sucker casing segment 9.

The at least three cooperating casing segments, which engage with one another in a meshing fashion during format adjustment, result in the functional surface 12 outside of the meshing region of the segment teeth, which surface extends in the circumferential direction, and which can also be used across the full drum width or sheet width for auxiliary functions. The extended functional surface 12 can be allocated to gripper casing segment 8 or to sucker casing segment 9, or can be divided between gripper casing segment 8 and sucker casing segment 9. This enlarged functional surface 12 can be used, for example, for a mechanical sheet knockout element on gripper casing segment 8 and/or for pneumatic elements on gripper casing segment 8 and/or on sucker casing segments 9.

The functional surface 12 that is created in the non-meshing sheet-supporting area of storage drum 2 is part of the sheet-supporting surface. In this case, the created functional surface 12 of storage drum 2 is assigned to sucker casing segment 9 and can have a circumferential extension of approximately 25°. Here, the functional surface 12 extends across the width of the drum and has an extension in the circumferential direction of storage drum 2. In this case, the circumferential extension of functional surface 12 is preferably located completely between the segment teeth of sucker casing segment 9 and the rotary suckers 17 thereof. The other casing half or the opposing sheet-bearing surface of the double-sized storage drum 2 is preferably embodied as identical to or diametrically opposite the first casing half or the first sheet-bearing surface. The other sheet-bearing surface likewise comprises, in particular, the strikes of the grippers, the sheet-supporting surfaces of the segment teeth of the leading and trailing casing segments, and the sheet-supporting surfaces of the middle casing segment, including the suction systems, where applicable.

Figure 4:
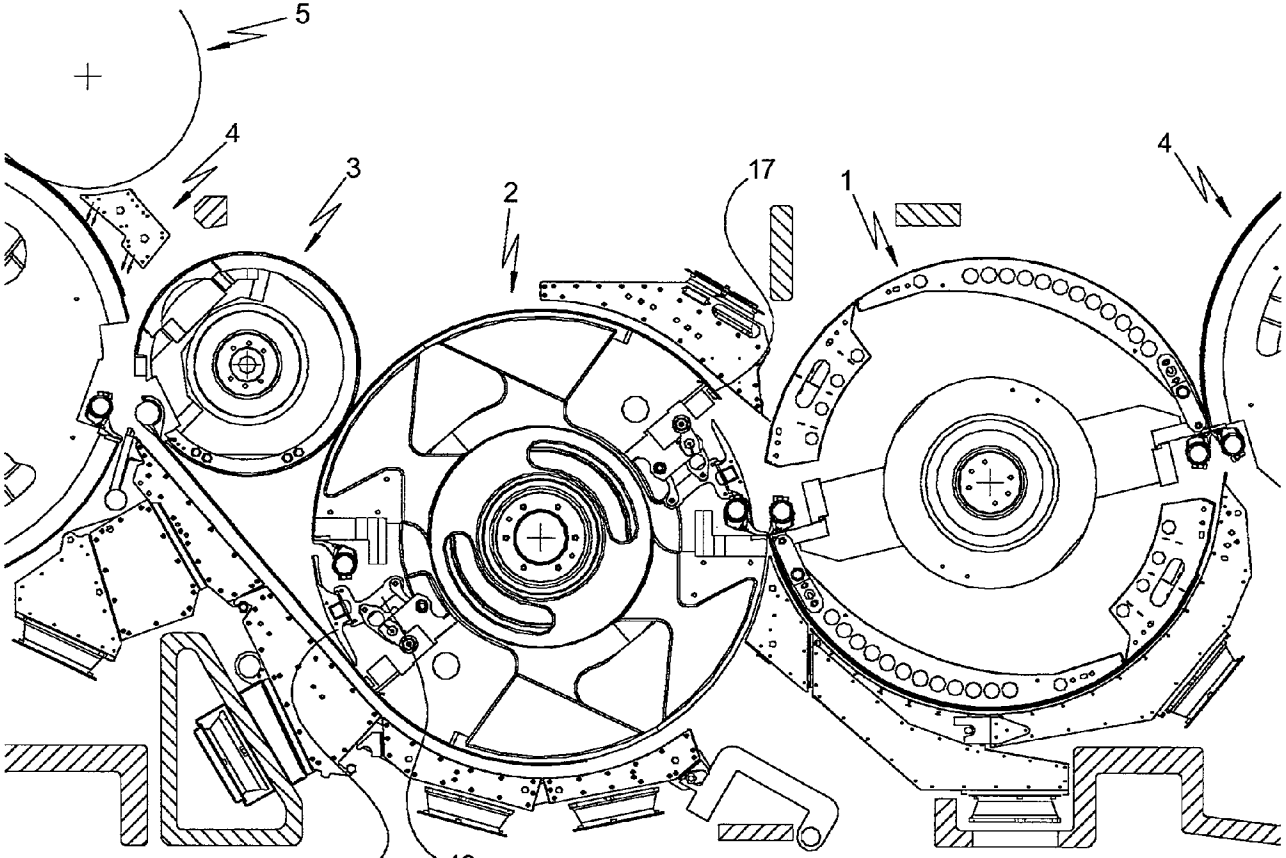
FIG. 4: a turning device comprising a storage drum which has a deflector plate in a gripper channel.

FIG. 4 shows a turning device with a storage drum 2 having a sheet-guiding element in a gripper channel. The turning device is part of a sheet-processing machine, for example a sheet-fed printing machine, in particular a sheet-fed rotary offset printing machine, preferably configured based on the unit construction principle, for example as described above. The turning device here is embodied as a three-drum turner comprising a double-sized transfer drum 1, for example, the double-sized storage drum 2 and a single-sized turning drum 3. Transfer drum 1 has sheet-supporting lateral surfaces and is arranged here downstream of a printing cylinder 4 of an upstream printing unit. Arranged beneath transfer drum 1 are sheet-guiding elements for sheet guidance. The sheet-guiding elements are preferably embodied as sheet-guiding plates and, in a further refinement, are equipped with pneumatic guide means. In particular, blast nozzles are arranged in the guiding surface of the sheet-guiding plates, and can be acted upon by blast air or suction air. For the purpose of sheet guidance, an air cushion is preferably produced by the sheet-guiding plates, by means of which the sheets are held on the lateral surface of transfer drum 1. In addition, sheet-guiding elements, in particular sheet-guiding plates, are also assigned to storage drum 2 and/or turning drum 3.

Storage drum 2 is mounted rotatably at both ends in side frames of the machine and contains two gripper systems 6 arranged diametrically opposite one another in gripper channels. Each gripper system 6 here comprises a gripper shaft, which is mounted in bearing supports and to which the gripper fingers are fixedly allocated across the width of the drum. The gripper shaft is driven by at least one roller lever via a cam follower and cam disk (not shown). The gripper systems 6 are arranged on leading, fixed casing segments, which support the leading portion of a sheet that is clamped by a gripper system 6. Spaced from the leading casing segments in the circumferential direction of storage drum 2, trailing casing segments are provided, which support the trailing portion of a sheet that is clamped by a gripper system 6. The trailing casing segments are embodied as displaceable or adjustable in the circumferential direction of storage drum 2, so that sheets of different formats can be supported both by the leading casing segments and by the directly corresponding trailing casing segments. The casing segments are preferably embodied as format-adjustable in that segment teeth of the casing segments engage with one another in a meshing fashion, thereby forming a lateral surface that will support a sheet. The two diametrically opposing trailing casing segments of the double-sized storage drum 2 are preferably moved jointly in relation to the fixed leading casing segments for the purpose of format adjustment. A common drive mechanism or synchronized drive mechanisms may be used for this purpose. However, storage drum 2 could also have guide strips and/or gripper recesses on its lateral surface, or additional, for example centrally positioned, movable casing segments.

On each of the trailing casing segments, which in this case are adjustable in relation to the leading casing segments, suction systems, in this case specifically rotary suckers 17, are preferably provided for picking up and guiding the sheet trailing edges. Rotary suckers 17 can be used for straightening the sheets longitudinally and/or transversely during their transport from transfer drum 1 to turning drum 3, while they are lying on storage drum 2 and/or, in perfecting printing, downstream of the central transfer point. In the area around the central transfer point between storage drum 2 and turning drum 3, the supply of suction air to rotary suckers 17 is preferably reduced, and in perfecting printing is particularly preferably interrupted, to enable the grippers of turning drum 3 to pick up the trailing edge of the sheet and in particular to separate it from storage drum 2. As an alternative or further refinement, storage drum 2 can have additional pneumatic elements. Such additional pneumatic elements can be integrated, for example, into the sheet-supporting surface and/or into the gripper channels of storage drum 2. For example, the leading and/or trailing casing segments and/or the segment teeth may be provided with pneumatic elements, in particular suction openings and/or grooves.

Figure 5:
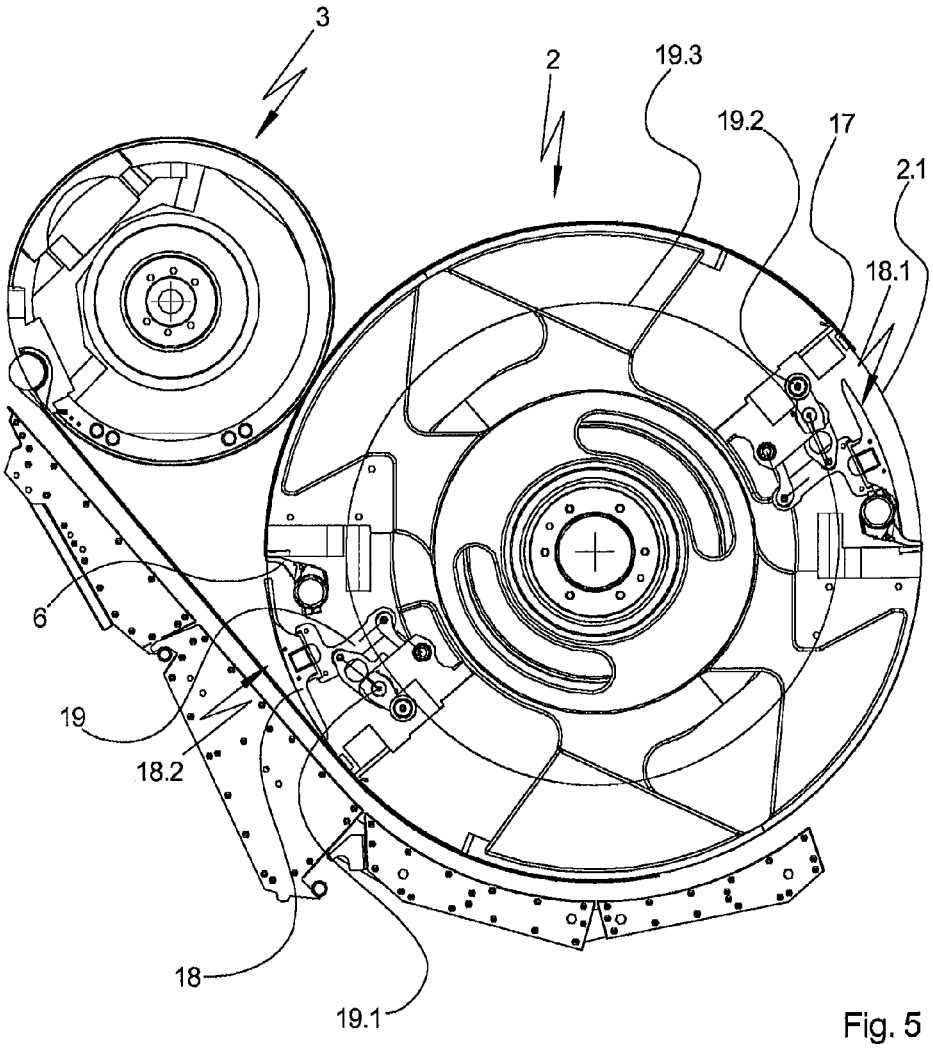
FIG. 5: an embodiment of a deflector plate of a storage drum, which is movable by means of a four-bar linkage.

FIG. 5 shows a sheet-guiding element that can be moved by a guide gearing mechanism, in a gripper channel of a sheet-guiding drum, embodied here as a storage drum 2, for example. In a double-sized storage drum 2, the sheet-guiding elements can be arranged in each of the two gripper channels. Each of the sheet-guiding elements may be arranged as an integral element or as multiple parts in a respective gripper channel. A sheet-guiding element may extend across only part, or across the entire width of the drum in the gripper channel. Sub-elements of the sheet-guiding element may also be assigned only to the channel walls, for example, to protect the gripper system 6 and/or the rotary sucker 17. The sheet-guiding element preferably extends in the circumferential direction from rotary suckers 17 to beyond gripper system 6 in the same gripper channel. The sheet-guiding element can be moved in particular in clocked cycles by the guide gearing mechanism. Preferably, the sheet-guiding element is moved in a radial direction within the gripper channel and/or beyond the storage drum periphery 2.1. The sheet-guiding element can also be pivoted.

The guide gearing mechanism is preferably embodied as a multi-linkage mechanism, particularly preferably as a coupler mechanism, and in this case is embodied, in particular, as a four-bar linkage 19. The sheet-guiding element is particularly preferably embodied as a deflector plate 18, which in a further refinement may also be embodied as pneumatically operated. Deflector plate 18 can be moved by the guide gearing mechanism, here the four-bar linkage 19, at least between a parked position 18.1, in which deflector plate 18 is located within the storage drum periphery 2.1, and a working position 18.2, in which deflector plate 18 is located at least approximately at the level of the storage drum periphery 2.1. In working position 18.2, at least the trailing edge of deflector plate 18 in the direction of rotation can protrude beyond the storage drum periphery 2.1. In this position, the trailing edge can lie, for example, 1 to 20 mm, preferably 1 to 10 mm, and particularly preferably approximately 5 mm above the storage drum periphery 2.1. The leading edge of deflector plate 18 preferably lies at least approximately at the level of the storage drum periphery 2.1. Gripper system 6 in the gripper channel is preferably covered by deflector plate 18 in both positions.

In parked position 18.1, deflector plate 18 is located within the storage drum periphery 2.1 in the gripper channel, so that a sheet trailing edge can be gripped by a turning drum 3, for example by means of a pincer gripper, at the central transfer point to the turning drum 3. Preferably, in the parked position 18.1, deflector plate 18 is located completely within the storage drum periphery 2.1 in the gripper channel. In the embodiment shown, in the parked position 18.1, deflector plate 18 is located at least approximately equidistant from the storage drum periphery 2.1. Alternatively, however, the deflector plate may also occupy other positions in the gripper channel. In working position 18.2, in contrast, deflector plate 18 is able to guide sheets that are sliding along the storage drum periphery 2.1 in the circumferential direction. By using a four-bar linkage 19 as the guide gearing mechanism, rather than a mere pivoting movement of deflector plate 18, deflector plate 18 can be maintained in its precise working position 18.2 and can be guided precisely into its parked position 18.1. As a result, the guide surface of deflector plate 18 can span nearly the entire gripper channel, in particular in the working position 18.2, when the maximum format is set.

The four-bar linkage 19 comprises two pivot joints in the gripper channel, which are fixed in relation to the drum body and on each of which a coupler is rotatably mounted. The two couplers are connected rotatably at their free ends to a common coupling link. The common coupling link supports deflector plate 18 on the side of said link that faces radially toward storage drum periphery 2.1. Deflector plate 18 is preferably permanently assigned to the coupling link. Where necessary, the coupling link can be driven by means of a drive mechanism to move deflector plate 18 radially in relation to storage drum 2. Here, the coupler on the side of the storage drum periphery 2.1 is mounted at a fulcrum 19.1 and extends beyond said fulcrum 19.1. On the extension of the coupler, a four-bar cam follower 19.2 is rotatably held. Four-bar cam follower 19.2 cooperates with a four-bar control cam 19.3. Four-bar cam follower 19.2 can be held in contact with four-bar control cam 19.3 via pressure means. Four-bar control cam 19.3 can be used to transmit movement via the couplers from four-bar cam follower 19.2 to the coupling link, in order to move deflector plate 18.

Figure 6:
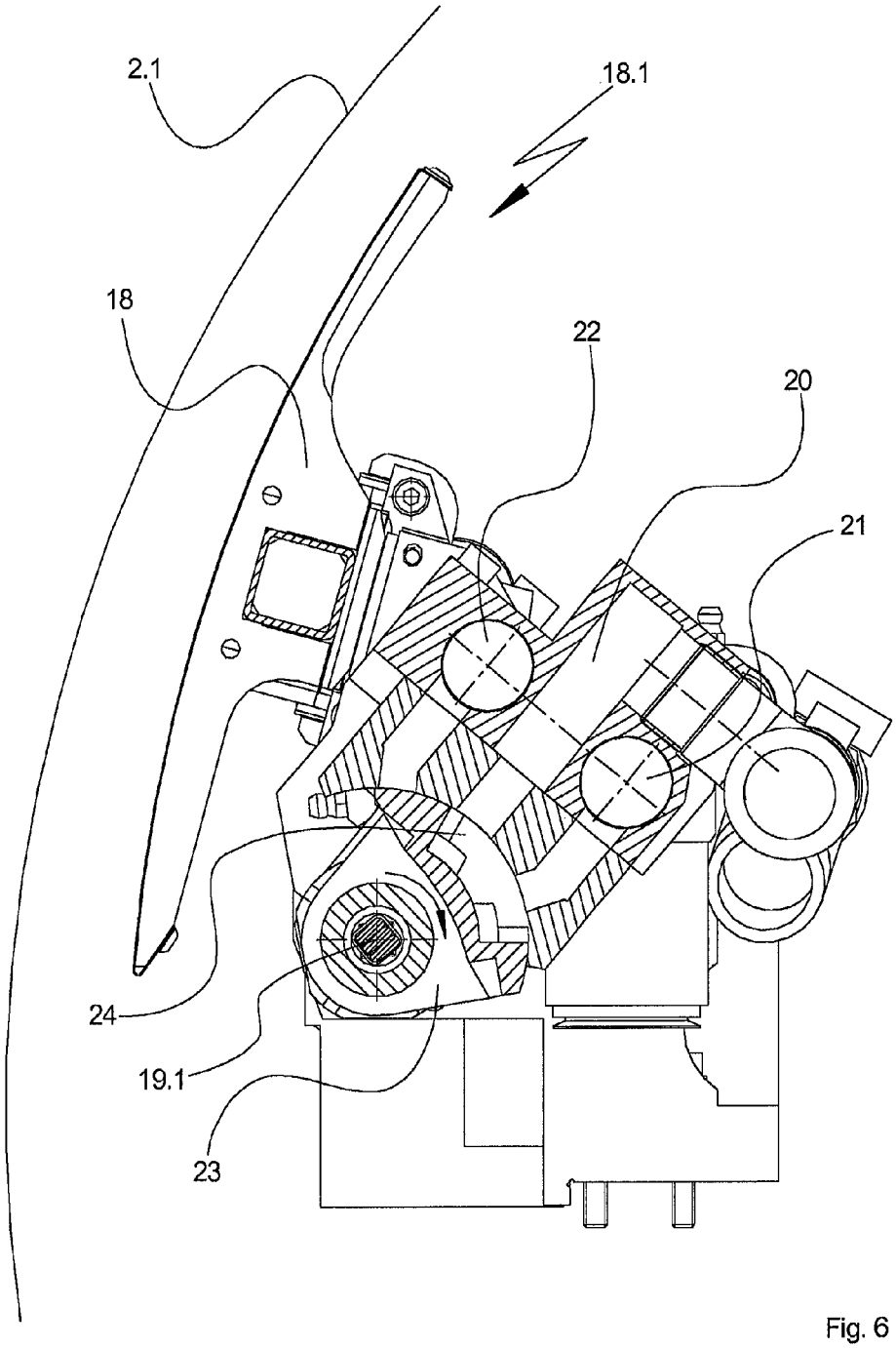
FIG. 6: an embodiment of a deflector plate in the parked position in a gripper channel of a storage drum.

FIG. 6 shows a pneumatically operable sheet-guiding element arranged in a gripper channel of a sheet-guiding drum. For this purpose, the sheet-guiding element has at least one opening that comes into contact with the sheet, at least intermittently. The sheet-guiding element may be arranged as an integral element or as multiple parts in the gripper channel. A sheet-guiding element may extend across only part or across the entire width of the drum in the gripper channel. Sub-elements of the sheet-guiding element may also be assigned only to the channel walls, for example, to protect the gripper system 6 and/or the rotary sucker 17. The sheet-guiding element may be arranged fixedly in the gripper channel. Preferably, however, the sheet-guiding element is embodied as The sheet-guiding element in this case is embodied, in particular, as a deflector plate 18 arranged in a gripper channel of a double-sized storage drum 2, for example. Here, deflector plate 18 can occupy a position, for example a parked position 18.1, which is located within the storage drum periphery 2.1 in the gripper channel. Deflector plate 18 has an at least approximately closed guide surface for the sheets, in which pneumatic openings, for example suction nozzles, are arranged. The guide surface of deflector plate 18 is preferably curved in accordance with the storage drum periphery 2.1. Deflector plate 18 preferably extends at least approximately across the entire width of the drum. In a further refinement, deflector plate 18 is configured in the circumferential direction of storage drum 2 such that a gripper channel of a storage drum 2 adjusted to the maximum format is at least approximately covered. Preferably, deflector plate 18 extends from the rotary suckers 17, which are in the leading position in the direction of rotation of storage drum 2, directly up to the gripper system 6, which is in the trailing position in the gripper channel.

The rotary suckers 17 are additional pneumatic elements of storage drum 2, which are preferably configured to be activated dependent on the rotational angle. The pneumatic openings in deflector plate 18 and the additional pneumatic elements, in particular the rotary suckers 17, of storage drum 2 have a common pneumatic line. The common pneumatic line may be embodied as rigid or as flexible, and is preferably guided at least roughly up to the gripper channel of storage drum 2. The common pneumatic line is connected to at least one air generator, in this case a suction air generator. The other casing half or sheet-bearing surface of the double-sized storage drum 2 is preferably likewise assigned a common pneumatic line for the other deflector plate 18 and the other pneumatic element, in particular the rotary sucker 17 positioned immediately downstream of said plate. In a further refinement, a plurality of different suction air generators for the different pneumatic elements of storage drum 2 may also be provided. This enables different suction air levels to be provided to the different elements.

A switching means is assigned to storage drum 2 for the selective pneumatic actuation of the sheet-guiding element, in particular deflector plate 18, or the additional pneumatic element, in particular rotary sucker 17. The switching means may be arranged, for example, in a gripper channel. The switching means is preferably embodied as a control valve for controlling the air, which is operatively connected to the common pneumatic line. In a preferred embodiment, the control valve is a pivoting slide valve 23, which is moved by a drive lever of the four-bar linkage of the controlled deflector plate 18, and thereby activates the suction air of deflector plate 18 before deflector plate 18 has reached its working position 18.2. Pivoting slide valve 23 has two working positions, for example, for supplying suction air to two pneumatic operating elements, in this case the rotary suckers 17, next to deflector plate 18. In a further refinement, additional pneumatic elements of storage drum 2 can be assigned to the common pneumatic line and can be supplied accordingly individually in succession or in groups.

In the embodiment shown, the common line for supplying pneumatic force to the various elements is routed up to at least one suction air connection 20, which is centrally located, for example. Preferably, a plurality of such suction air connections 20, for example two, are arranged across the width of the drum. These suction air connections 20 are preferably embodied as identical and/or as arranged symmetrically with respect to the drum width. A suction air connection 20 is arranged adjacent to a suction air channel 21 of a suction system, for example rotary sucker 17, on one side and adjacent to a suction air channel 22 of deflector plate 18 on the other side. Suction air connection 20 and suction air channels 21, 22 for the suction system, in particular rotary suckers 17, and for deflector plate 18 are accommodated here in a single structural unit. This structural unit is operatively connected to pivoting slide valve 23.

Pivoting slide valve 23 comprises a channel section 24, which in this case is perpetually connected pneumatically to suction air connection 20. Pivoting slide valve 23 can be pivoted between the at least two working positions. The pivoting movement is preferably effected by a drive mechanism that pivots said slide valve about a pivot axis. In a first working position, suction air is supplied to the suction system, in this case rotary suckers 17, while at the same time the supply of suction air to deflector plate 18 is interrupted. Here, in the parked position 18.1 located in the gripper channel, deflector plate 18 is not supplied with pneumatic force. In this parked position 18.1, no suction air can be applied to the suction openings of deflector plate 18. Instead, in this first working position of pivoting slide valve 23, a pneumatic connection to rotary suckers 17 is established via channel section 24. In a second working position, suction air is supplied to deflector plate 18, while at the same time, the supply of suction air to the suction system, in particular rotary suckers 17, is interrupted. Further positions, in which pneumatic force is supplied to different elements, or is not supplied to any elements, are also conceivable. Additional switching elements that influence the common supply of suction air may be arranged upstream of the common line.

Figure 7:
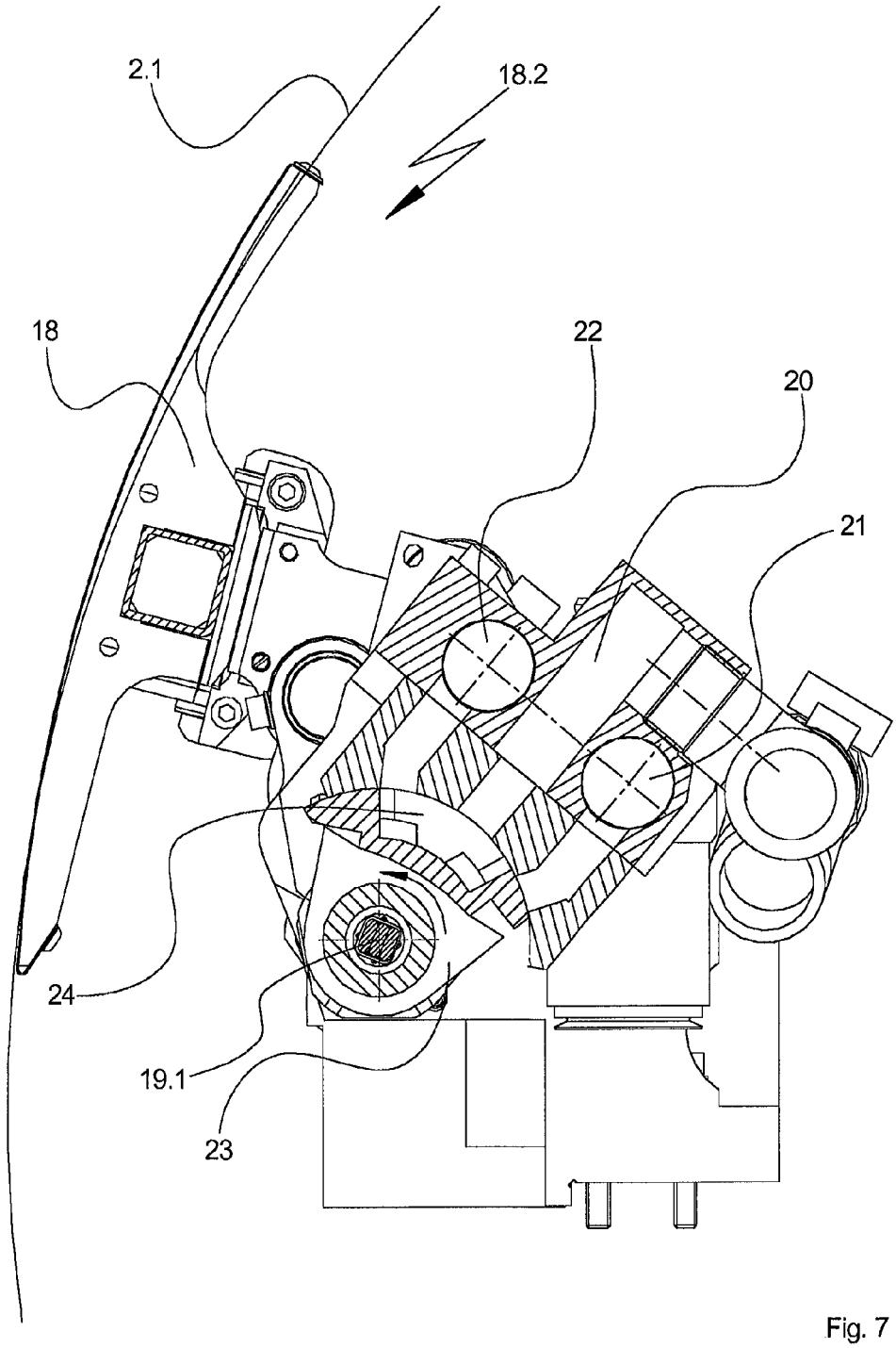
FIG. 7: a deflector plate in the operating position at the level of the periphery of the storage drum.

In FIG. 7, deflector plate 18 has been placed in working position 18.2, preferably by means of the four-bar linkage, and is located here at the level of storage drum periphery 2.1. Here, the four-bar linkage preferably also controls pivoting slide valve 23. Pivoting slide valve 23 is particularly preferably arranged in a pivot joint of the four-bar linkage, which is fixed with respect to the drum body, for example in the above-described fulcrum 19.1 of four-bar linkage 19. When pivoting slide valve 23 is pivoted in a counterclockwise direction in this case, channel section 24 of pivoting slide valve 23 interrupts the pneumatic connection to rotary suckers 17 in this working position, and instead establishes a pneumatic connection to deflector plate 18. The pivoting movement preferably also displaces deflector plate 18 into its working position 18.2. In a further refinement, blast air can also be supplied to the pneumatic elements of storage drum 2. In a further refinement, the two alternatingly activated air supplies are also connected to two different air generators by a combination with a rotary valve in the direction of the air generators. This enables different pressure and/or suction air levels to be generated at the pneumatic elements of storage drum 2.

The switching means is reversed, in particular, during the rotation of storage drum 2 in the perfecting printing mode, when the sheet to be turned has already been gripped by turning drum 3 and will be removed from storage drum 2 during the turning process. In this way, a common pneumatic guidance of the sheets is achieved by the pneumatic elements of storage drum 2 and by deflector plate 18 in the gripper channel. Here, pneumatic guidance is carried out first by means of suction elements and/or by the perfecting cylinder suckers, in particular rotary suckers 17, of storage drum 2. The suction elements or rotary suckers 17 can remain active as long as contact is maintained between the sheet in question to be turned and the suction elements or rotary suckers 17. Before or as soon as the turning process eliminates the contact between the sheet and the suction elements or rotary suckers 17, the suction elements or rotary suckers 17 are pneumatically deactivated, to prevent them from drawing any infiltrated air. At the same time, deflector plate 18 is pneumatically activated, so that sheet guidance is continued therewith.

The preferably pneumatically supported sheet guidance by means of deflector plate 18 is preferably maintained until the sheet to be turned also loses contact with the plate. In this way, the common guidance of the sheets by means of the suction elements and/or perfecting cylinder suckers, in particular rotary suckers 17, the drum, and the sheet-guiding element in the gripper channel, in particular deflector plate 18, in succession is achieved. In this process, the sheet is guided by the rotational angle-dependent activation of suction air to the additional element, followed by the rotational angle-dependent activation of suction air to the sheet-guiding element, in particular to deflector plate 18, by the switching means, in particular the control valve and preferably by pivoting slide valve 23. The pneumatic action can be reduced or eliminated when there is no longer any sheet contact. In particular, a rotational angle-dependent deactivation is provided.

Figure 8:
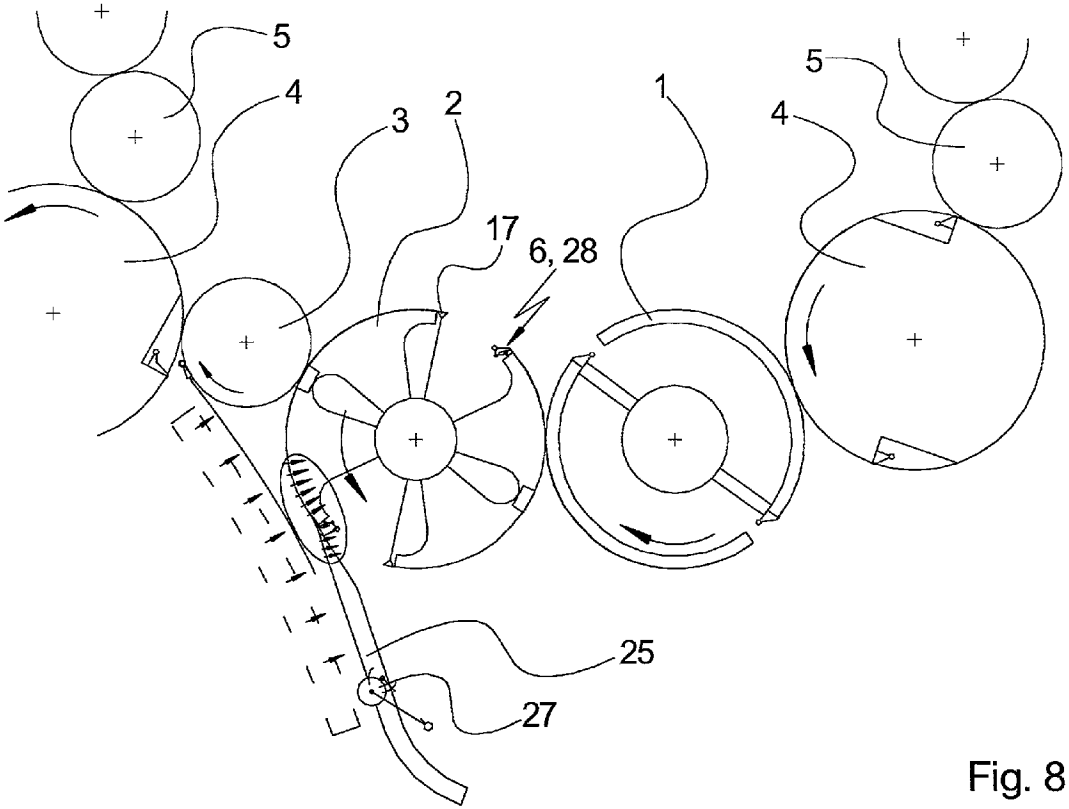
FIG. 8: a turning device for a sheet-processing machine with a separation device set against the storage drum.

FIG. 8 shows a turning device for a sheet-processing machine, for example as described above, with a separation device 25 that can be set against the sheet-guiding drum, in particular storage drum 2. The sheet-guiding drum, in particular storage drum 2, is assigned a lifting system for lifting the leading edge of the sheet away from the sheet-supporting surface and for transferring it to separation device 25. The turning device is part of a sheet-processing machine, for example a sheet-fed printing machine, in particular a sheet-fed rotary offset printing machine, preferably configured based on the unit construction principle, for example as described above. The turning device is embodied here as a three-drum turning unit comprising a double-sized transfer drum 1, a sheet-guiding drum configured as a double-sized storage drum 2, and a single-sized turning drum 3. Transfer drum 1 has sheet-supporting lateral surfaces and is arranged here downstream of a printing cylinder 4 of an upstream printing unit. Additionally assigned to storage drum 2, but preferably as an alternative to a sheet-guiding element in the gripper channel, is the separation device 25 for storing a sheet during the turning process. Separation device 25 is embodied, for example, as a guide blade, and preferably has pneumatic elements for guiding the sheet on the surface.

Storage drum 2 is mounted rotatably at both ends in side frames of the machine and contains two gripper systems 6 arranged diametrically opposite one another in gripper channels. Each gripper system 6 here comprises a gripper shaft, which is mounted in bearing supports and to which the gripper fingers are fixedly allocated across the width of the drum. The gripper shaft is driven by at least one roller lever via a cam follower and cam disk (not shown). Gripper systems 6 are arranged on leading, fixed casing segments, which support the leading portion of a sheet that is clamped by a gripper system 6. Spaced from the leading casing segments in the circumferential direction of storage drum 2, trailing casing segments are provided, which support the trailing portion of a sheet that is clamped by a gripper system 6. The trailing casing segments are embodied as displaceable or adjustable in the circumferential direction of storage drum 2, so that sheets of different formats can be supported both by the leading casing segments and by the directly corresponding trailing casing segments. The casing segments are preferably embodied as format-adjustable in that segment teeth of the casing segments engage with one another in a meshing fashion, thereby forming a lateral surface that will support a sheet. The two diametrically opposing trailing casing segments of the double-sized storage drum 2 are preferably moved jointly in relation to the fixed leading casing segments for the purpose of format adjustment. A common drive mechanism or synchronized drive mechanisms may be used for this purpose. However, storage drum 2 could also have guide strips and/or gripper recesses on its lateral surface, or additional, for example centrally positioned, movable casing segments.

On each of the trailing casing segments, which in this case are adjustable in relation to the leading casing segments, suction systems, in this case specifically rotary suckers 17, are preferably provided for picking up and guiding the sheet trailing edges. Rotary suckers 17 can be used for straightening the sheets longitudinally and/or transversely during their transport from transfer drum 1 to turning drum 3, while they are lying on storage drum 2 and/or, in perfecting printing, downstream of the central transfer point. In the area around the central transfer point between storage drum 2 and turning drum 3, the supply of suction air to rotary suckers 17 is preferably reduced, and in perfecting printing is particularly preferably interrupted, to enable the grippers of turning drum 3 to pick up the trailing edge of the sheet and in particular to separate it from storage drum 2. As an alternative or further refinement, storage drum 2 can have additional pneumatic elements. Such additional pneumatic elements can be integrated, for example, into the sheet-supporting surface and/or into the gripper channels of storage drum 2. For example, the leading and/or trailing casing segments and/or the segment teeth may be provided with pneumatic elements, in particular suction openings and/or grooves.

The sheet-guiding drum, embodied here, for example, as a storage drum 2, comprises, in addition to gripper system 6, a further sheet-holding device, which is adjacent to gripper system 6 and is assigned to the sheet-supporting surface. The additional sheet-holding device may be assigned to the fixed casing segments and/or may have a separate holder. The additional sheet-holding device is positioned, in particular, at the level of the periphery of the sheet-guiding drum, and is assigned, for example, to gripper system 6, indirectly or immediately adjacent thereto. Moreover, the additional sheet-holding device is arranged downstream of gripper system 6 in the direction of rotation of the sheet-guiding drum. In particular, the additional sheet-holding device comprises suction openings and/or separately actuable holding areas. Preferably, the sheet-holding device comprises suction openings that are preferably independently actuable transversely and/or in the circumferential direction of the sheet-guiding drum. Said additional sheet-holding device may extend transversely, that is, width-wise across the drum, or across only a partial area of the drum. Particularly preferably, the additional sheet-holding device is provided at least in the lateral region of the sheet-guiding drum and can be deactivated outside of the current sheet format.

More particularly, the additional sheet-holding device can be actuated separately, with actuation preferably being dependent on the rotational angle. Alternatively, the additional sheet-holding device can be actuated dependent on gripper system 6, more particularly on an opening movement of gripper system 6. If the additional sheet-holding device has independently actuable holding areas, these can be actuated in succession in the circumferential direction of the sheet-guiding drum. Thus, these holding areas can be activated collectively or in succession, and/or can be deactivated in succession based on the rotational progress of the sheet-guiding drum.

Figure 9:
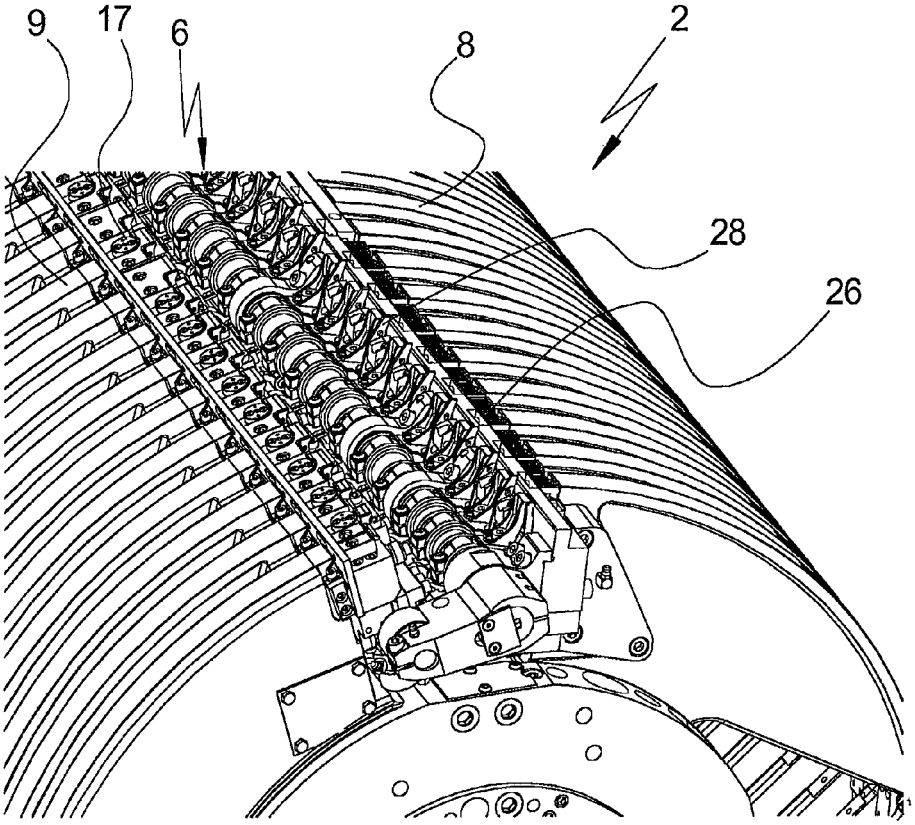
FIG. 9: auxiliary suckers in the region of a gripper system of a storage drum.

FIG. 9 shows an additional sheet-holding device in the region of a gripper system 6 of a sheet-guiding drum, here in particular a storage drum 2. Storage drum 2 comprises auxiliary suckers 26, which are assigned to gripper system 6 and are located adjacent thereto and spaced, for example, 0.1 to 20 cm, preferably 0.5 to 10 cm, and particularly preferably 1 to 5 cm in the circumferential direction from the gripper strikes, in this case in the direction of a gripper casing segment 8. Here, auxiliary suckers 26 are assigned across the width of the drum to the lateral regions of storage drum 2, that is to say the regions thereof that face the end faces. The additional sheet-holding device is thus preferably located at least in the format-variable regions of the sheet-guiding drum, in this case specifically storage drum 2.

Storage drum 2 further preferably comprises a lifting system assigned to each gripper system 6, which lifts the leading edge of the sheet, which has been released by gripper system 6, away from the sheet-supporting surface and guides it onto separation device 25 in the rotational angle range thereof. In this case, a lifter 28 that is movable over the periphery of storage drum 2 is assigned to nearly every gripper finger of gripper system 6. The lifters 28 can be moved over the periphery in the radial direction, for example, thereby separating the leading edges of sheets from the sheet-supporting surface. The lifters 28 may be actuated separately or by means of gripper system 6, in particular by the opening movement of gripper system 6. The additional sheet-holding device is preferably configured such that the sheet leading edge that is separated from the sheet-supporting surface by lifters 28 while the gripper fingers are open can be secured in the adjacent portion of the sheet. Within a certain rotational angle range of storage drum 2, the leading edge of the sheet is held only by the additional sheet-holding device, while the leading edge of the sheet is guided onto separation device 25.

During the turning process, each sheet is clamped at its leading edge in the turning device by one of the gripper systems 6 of storage drum 2. In the perfecting printing mode, the sheet to be turned is guided with its leading edge forward onto storage drum 2. During turning, the sheet is advanced by storage drum 2 beyond the central transfer point to turning drum 3, thereby allowing the auxiliary suckers 26 to also secure the leading portion of the sheet. Storage drum 2 guides the sheet up to the tip of separation device 25. Shortly before it reaches the tip, gripper system 6 executes an opening movement, causing the gripper fingers to release the leading edge of the sheet. At the same time, the released leading edge of the sheet can be lifted by knockout elements 28, so that the leading edge of the sheet is lifted onto separation device 25. The auxiliary suckers 26 hold as much of the sheet as is possible on storage drum 2, thereby limiting the free-flying portion of the leading sheet edge. In particular, the length of the free-flying portion is determined by the distance between knockout elements 28 and the respectively activated auxiliary suckers 26. This facilitates the jump of the sheet leading edge, which is guided in a defined manner, to separation device 25. Pneumatic guide elements are preferably assigned to separation device 25, and guide the sheet leading edge as soon as it is in the operating area of separation device 25. Particularly preferably, the sheet leading edge is guided onto separation device 25 by means of the aerodynamic paradox or by suction.

The sheet can be released by the additional sheet-holding device as soon as guidance of the sheet is taken over at least partially by separation device 25. The holding action of the additional sheet-holding device can be embodied as adjustable on the basis of sheet format or base weight, and/or according to sensor values. The applied level of suction can also be embodied as adjustable. In a further refinement, different holding regions may be adjustable independently of one another. Particularly if a plurality of holding regions are arranged in the circumferential direction, these may be activated and deactivated in succession and/or different holding force intensities may be applied. In this way, a sheet that is held at least partially on separation device 25 can be released by the sheet-holding device one area a time in succession in the circumferential direction. This also enables the formation of diminishing suction in the circumferential direction.

While the sheet leading edge is being guided onto separation device 25, the leading portion of the sheet continues to be held on the sheet-supporting surface of storage drum 2 by the auxiliary suckers 26, and thus continues to be guided in a defined manner. Separation device 25 can thus pick the sheet up directly from storage drum 2, without the sheet having to jump from a sizeable distance. Particularly preferably, the holding force of the additional sheet-holding device or the suction of the auxiliary sucker 26 is applied until separation device 25 has taken over secure guidance of the sheet. The sheet, which has been largely guided by storage drum 2 onto separation device 25, is then captured at its trailing edge by turning drum 3. The trailing edge of the sheet, which at that point is still resting on storage drum 2, is then taken over by the gripper, in particular by a pincer gripper or by grippers and/or suckers, which are mounted pivotably in the rotating turning drum 3. As the rotation of turning drum 3 continues, the captured sheet is then turned according to the principle of trailing edge turning, so that when its movement is reversed, what was formerly its trailing edge becomes its new leading edge, and what was formerly its leading edge lying on separation device 25 becomes its new trailing edge. The sheet being pulled off can be separated from separation device 25 by a separating element 27 assigned to separation device 25. Separating element 27 may be embodied as a curved finger or as a suction roller. The sheet can be moved out of the path of the sheet following it by means of one or more separating elements 27. Preferably, separating element(s) 27 are moved out of separation device 25 and back again in clocked cycles. The guidance of the sheet from storage drum 2 or separation device 25 to turning drum 3 can be supported by additional pneumatic sheet-guiding elements. Alternatively or additionally, the additional sheet-holding device can also be embodied as an electrostatic and/or magnetic sheet-holding device.

In a further refinement, separation device 25 can also be configured with an existing separating element 27 in a modular construction. This enables a joint adjustment of separation device 25 in relation to the sheet-guiding drum. More particularly, this enables separation device 25 to be displaced laterally through an opening in the machine side wall. Such a displacement can be used for maintenance purposes. A separation device 25 can also be removed or inserted through the opening in the machine side wall. Particularly preferably, all connections, in particular the pneumatic connections, of separation device 25 are coupled and uncoupled automatically. In particular, the functional elements of separation device 25 are combined according to their function in the structural unit and are integrated as a blade module. The blade module is preferably mounted in the machine frame so as to be axially displaceable on guides as a complete modular unit, and preferably so as to be movable out of the machine in the direction of the operating side, from a working position to a maintenance position. Stops, holding device, and/or control units for securing the position of the blade module in the working position and/or a securing devices for locking the machine during movement thereof from this working position toward a maintenance position can be provided. A movable support for the sheet-holding elements or a structural unit for additional sheet-holding elements may be provided, which is mounted on guides in the blade module and can be displaced parallel to the direction of sheet travel for the collective adjustment of the sheet contact elements to a current sheet length. Such a movable support can be provided with drive mechanisms, a controller and/or a supply of air for sheet-holding elements. The structural unit for additional sheet-holding elements can likewise be mounted on guides on the movable support, and can preferably be movable, and optionally removable, toward the operating side, from a working position to a maintenance position, out of the movable support or out of the blade module. Stops, holding device, and/or control units for securing the position of the structural unit for the additional sheet contact elements in the working position and/or for locking the machine during the movement thereof from the working position to the maintenance position may be provided. A guide blade in the blade module can be mounted so as to pivot about a fixed fulcrum. Stops and/or control devices for securing the position of the guide blade in the working position may also be provided. The guide blade can preferably be pivoted into a maintenance position by means of a machine lock-out device.

Figure 10:
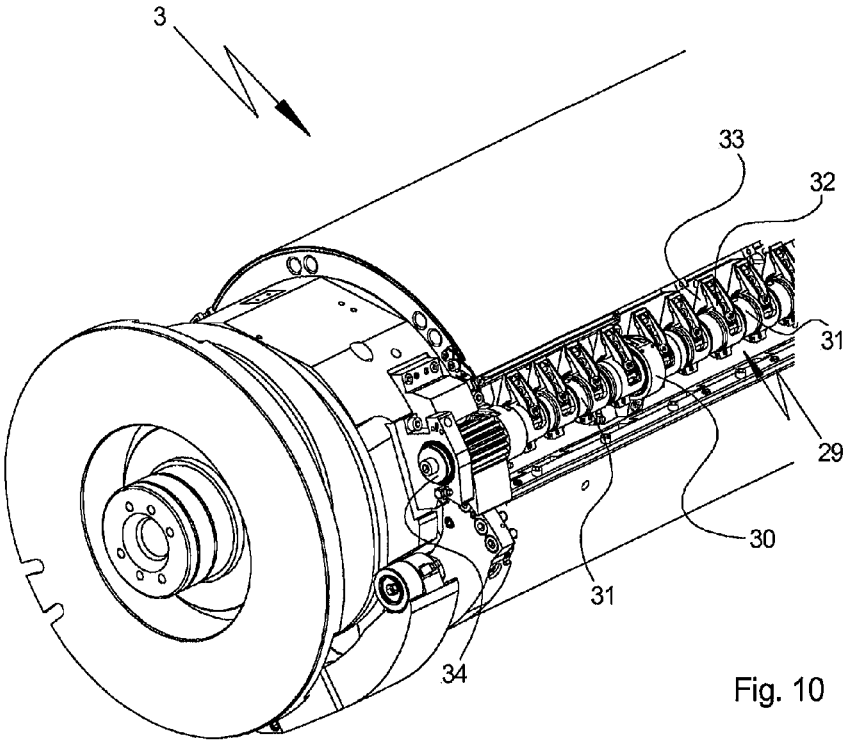
FIG. 10: a perspective view of a single-sized turning drum with a pincer gripper system.

FIG. 10 shows a perspective view of one embodiment, comprising a single-sized turning drum 3 of a turning device with a pincer gripper system 29. The turning device is part of a sheet-processing machine, for example a sheet-fed printing machine, in particular a sheet-fed rotary offset printing machine, preferably configured based on the unit construction principle, for example as described above. Turning drum 3 is preferably arranged downstream of a storage drum 2, which allows at least part of pincer gripper system 29 to dip into its periphery in order to grip the sheet trailing edge during the turning process. For this purpose, storage drum 2 may be equipped with format-adjustable casing segments and/or with guide strips on its peripheral surface. Turning drum 3 is mounted so as to rotate about a rotational axis in the side frames of the machine. Pincer gripper system 29 has a drive mechanism for gripping and/or pivoting. The drive mechanism of pincer gripper system 29 can be switched between the front-side printing mode and the perfecting printing mode. In this case, pincer gripper system 29 is preferably driven on both sides via cam followers.

In the front-side printing mode, pincer gripper system 29 executes a gripping movement for the purpose of picking up a sheet leading edge at the central transfer point with the upstream storage drum 2, and transferring it to the downstream sheet transport system, for example a printing cylinder 4. In the perfecting printing mode, in addition to the gripping movement, pincer gripper system 29 executes a pivoting movement as turning drum 3 continues to rotate, in order to transfer the trailing edge, which was taken over at the central point of transfer with the upstream storage drum 2, as the new leading edge to the downstream sheet transport system, for example a printing cylinder 4. When setting the format for perfecting printing, turning drum 3 can be adjusted jointly with the units that are arranged downstream of the turning device, so that pincer gripper system 29 can grip the sheet trailing edge of the current sheet format. Turning drum 3 has a sheet-supporting surface, which has at least the width of the largest sheet format to be processed. Turning drum 3 can also have a cap, which forms a lateral surface and which may be embodied as permanent or as replaceable. More particularly, a full-surface cap is used in the front-side printing mode. In the perfecting printing mode, the cap can be removed and/or a turning drum lateral surface having recesses, for example caverns and/or channels, may be provided for the purpose of transporting ambient air into the area where negative pressure is present between turning drum 3 and storage drum 2, and the sheet to be turned in each case.

Pincer gripper system 29 of turning drum 3 has a pincer gripper shaft 34 which is mounted concentrically in a gripper tube, and which has at least one recessed raceway 35. Preferably, pincer gripper shaft 34 has recessed raceways 35 at a plurality of bearing points, and most preferably at each bearing point. In addition, slotted needle roller and cage assemblies 36 are assigned to the recessed raceways 35 of pincer gripper shaft 34. Pincer gripper shaft 34, which is arranged concentrically inside the gripper tube, is mounted so as to rotate in relation to the gripper tube via the slotted needle roller and cage assemblies 36. The gripper tube is preferably embodied as at least a two-part component, with tube segments 31 being held by bearing points. A pincer gripper system 29 for a medium-format sheet-fed printing machine can have five tube segments 31 arranged side by side, for example, with two bearing points preferably being assigned to each tube segment 31. Each tube segment 31 can cooperate with one bearing point on each of its two sides. The bearing points arranged between the outer bearing points of turning drum 3 can hold two of the pipe segments 31 on their common interface.

The connection of two tube segments 31 of the gripper tube that abut against one another at an interface is preferably accomplished by means of connectors 37, in particular by means of sleeve couplings. The tube segments 31 of the gripper tube can be connected in a materially bonded and/or force-fitting manner via the connectors 37. Connectors 37 preferably have hardened raceways for the needle roller and cage assemblies 36, more particularly for the needle rollers, arranged in the recessed raceways 35. The two tube segments 31 that are connected to one another by means of a connector 37 are held in the region of the connector 37 so as to rotate on the needle rollers of the slotted needle roller and cage assembly 36 in relation to pincer gripper shaft 34.

The gripper tube is preferably produced in segments, preferably without heat treatment. The tube segments 31 of the gripper tube are then connected by means of connectors 37, in particular sleeve couplings, in a materially bonded connection, in particular by joining and/or gluing, and/or in a force-fitting connection, in particular by shrink fitting. The mutually adjacent tube segments 31 are thus connected across the width of the drum and are mounted on bearing points in relation to turning drum 3, whereas the internal pincer gripper shaft 34 can be rotated in relation to tube segments 31, in particular in relation to the gripper tube, which is formed from joined and/or connected tube segments 31, by means of the slotted needle roller and cage assemblies 36. The gripper tube formed from the joined tube segments 31 has an at least nearly closed lateral surface across the width of the drum, in particular across the width of the sheet-supporting surface.

Figure 11:
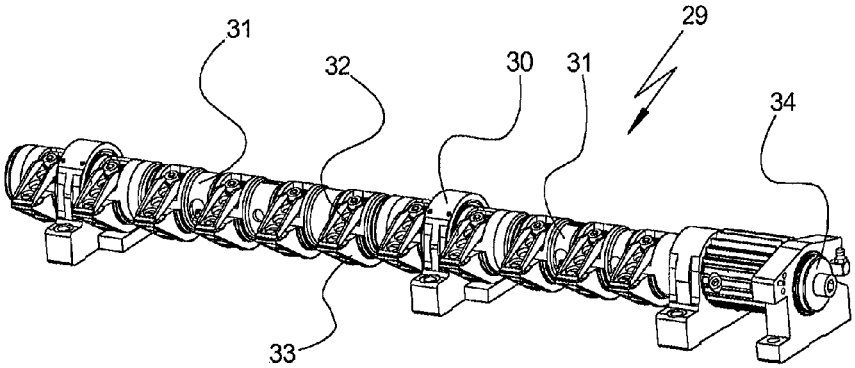
FIG. 11: a perspective view of the pincer gripper system.

FIG. 11 shows a perspective view of a part of pincer gripper system 29. Pincer gripper system 29 has a gripper tube and a pincer gripper shaft 34 mounted coaxially inside said tube. The gripper tube comprises a plurality of tube segments 31 that are connected to one another via connectors 37 (not shown). In the area of connectors 37, the gripper tube is held so as to rotate in turning drum 3 via pincer gripper bearing supports 30. Both the gripper tube and the pincer gripper shaft 34 that is arranged inside the gripper tube are rotatable about a rotational axis in relation to the pincer gripper bearing supports 30. This common rotational axis is parallel to the rotational axis of turning drum 3, and more particularly is concentric to pincer gripper shaft 34 and to the gripper tube. Gripper elements are assigned to both pincer gripper shaft 34 and the gripper tube. More particularly, a pincer gripper half that corresponds to a pincer gripper half which is assigned to pincer gripper shaft 34 or forms a clamping nip therewith is arranged on the gripper tube. The pincer gripper half arranged on the gripper tube here has strikes, arranged spaced from one another, which are fixedly connected to the gripper tube. In this case, spring-mounted gripper strikes 33 are preferably assigned to the gripper tube. The gripper tube further has recesses, in which the half of the pincer gripper which is assigned to pincer gripper shaft 34 is arranged. In this case, rigid gripper tongues 32 are fixedly connected in the recesses of the gripper tube to the pincer gripper shaft 34, which is located inside said tube. The rigid gripper tongues 32 can be fixedly connected, for example screw connected, to pincer gripper shaft 34, protruding through the recesses, for example. The spring-mounted gripper strikes 33 and the rigid gripper tongues 32 are arranged relative to one another in such a way that a clamping nip for sheet edges is formed between them.

Figure 12:
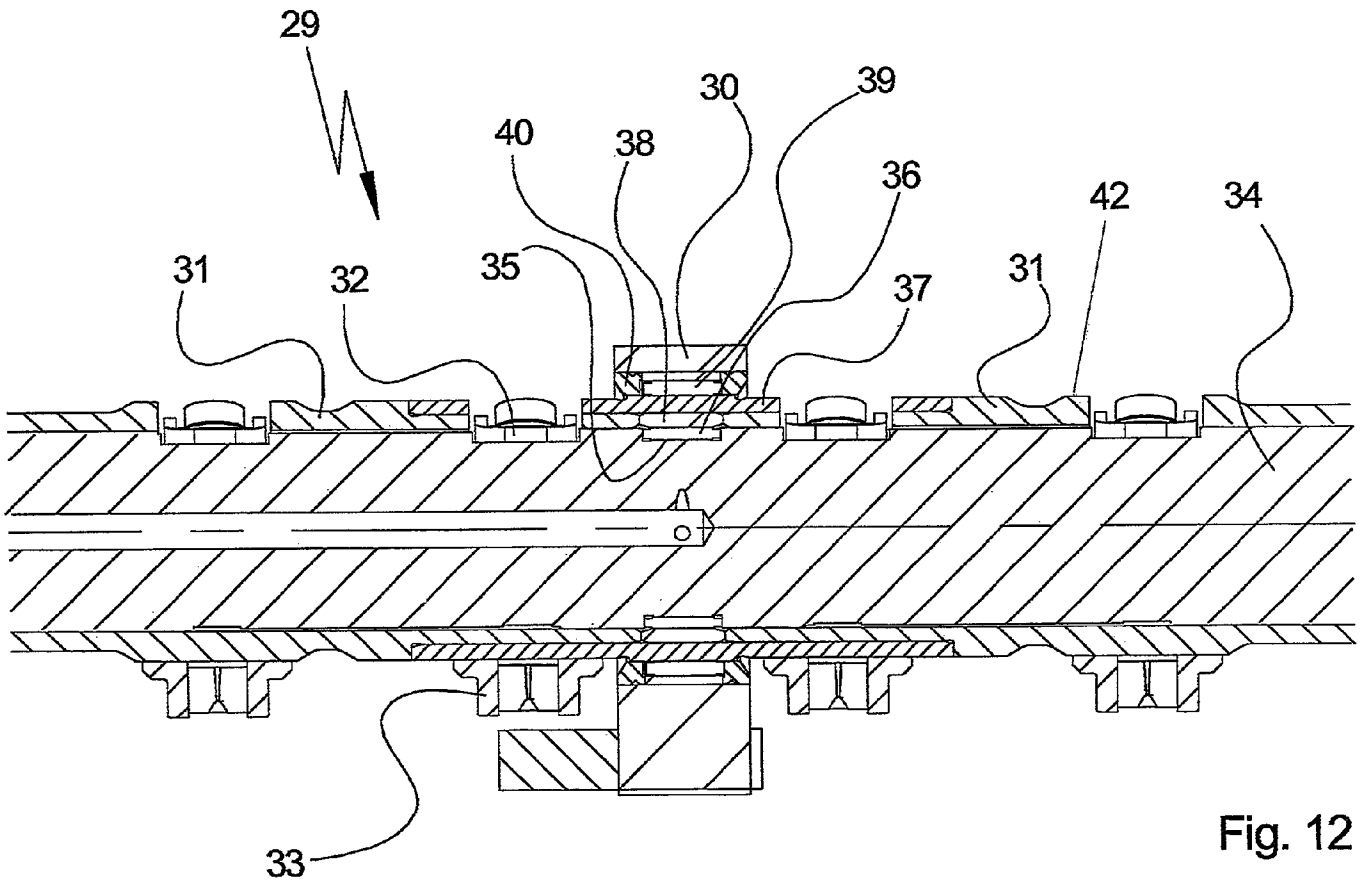
FIG. 12: a longitudinal section of a segment of the pincer gripper system.

FIG. 12 shows a longitudinal section of a segment of pincer gripper system 29. Pincer gripper shaft 34 is mounted so as to rotate about its rotational axis within the gripper tube, which is formed from tube segments 31 preferably by means of connectors 37 mounted on an outer lateral surface 42 of adjoining tube segments 31 and has the at least one recessed raceway 35. Slotted needle roller and cage assembly 36 is inserted into recessed raceway 35. The needle rollers of slotted needle roller and cage assembly 36 that run in recessed raceway 35 are guided by a hardened bearing surface, preferably a hardened bearing ring 38, in this case a fully hardened bearing ring. In the area of recessed raceway 35 and of slotted needle roller and cage assembly 36, the gripper tube composed of tube segments 31 is joined and is preferably connected in a force-fitting and/or materially bonded connection by means of a connector 37, for example a sleeve coupling. In a further refinement, connector 37 may also have the hardened, particularly preferably fully hardened, raceway for the needle rollers of the slotted needle roller and cage assembly 36. For this purpose, the hardened bearing ring 38 may be connected to or combined with connector 37. Connector 37 is further preferably held by a pincer gripper bearing support 30 via an additional needle roller and cage assembly 39. Between pincer gripper bearing support 30 and connector 37, axial securing elements 40 are provided on both sides of the additional needle roller and cage assembly 39, which may also provide a sealing effect. The additional needle roller and cage assembly 39 need not be embodied as slotted.

While preferred embodiments of a sheet-processing machine having a sheet-gripping drum, and a method for producing a gripper system, in accordance with the present invention, have been set forth fully and completely hereinabove, it will be apparent to one of skill in the art that changes could be made without departing from the true spirit and scope of the subject invention which is accordingly to be limited only by the appended claims.

The invention claimed is:

1. A sheet-processing machine having a sheet-guiding drum, wherein the sheet-guiding drum has a gripper system comprising a gripper shaft and a gripper tube, and wherein the gripper tube has an outer lateral surface and is composed of joined tube segments, characterized in that the gripper tube is mounted rotatably on the outer lateral surface of the gripper tube.

2. The sheet-processing machine according to claim 1, characterized in that the gripper tube is mounted at least at one connecting point of the joined tube segments.

3. The sheet-processing machine according to claim 1, characterized in that the gripper tube is supported at both axial ends, in each case by a bearing point that engages on the outer lateral surface of the gripper tube.

4. The sheet-processing machine according to claim 1, characterized in that the gripper tube surrounds the gripper shaft across the entire width of one of a sheet-bearing surface and a drive element for the gripper tube and the gripper shaft is mounted outside of a sheet-bearing surface.

5. The sheet-processing machine according to claim 1, characterized in that a drive pinion for one of the gripper tube and the gripper shaft is mounted at each end in relation to the drum body, on bearing supports.

6. The sheet-processing machine according to claim 1, characterized in that rigid gripper tongues that protrude through recesses in the gripper tube are allocated to the gripper shaft, and the gripper tube supports spring-mounted gripper strikes.

7. The sheet-processing machine according to claim 1, characterized in that one slotted needle roller and cage assembly is allocated to one recessed raceway of the gripper shaft, the gripper shaft is held within the gripper tube by needle roller and cage assemblies, and the gripper shaft is held concentrically to the gripper tube by needle roller and cage assemblies.

8. The sheet-processing machine according to claim 1, characterized in that at least one bearing support that supports the gripper tube cooperates with axial securing elements.

9. The sheet-processing machine according to claim 1, characterized in that two tube segments of the gripper tube are connected by one of a connector and a sleeve coupling, wherein bearing surfaces for needle roller and cage assemblies are formed at the connecting points of the tube segments.

10. The sheet-processing machine according to claim 1, characterized in that one of tube segments of the gripper tube and a tube segment and a connector are connected in one of a materially bonded and a force-fitting connection.

11. The sheet-processing machine according to claim 1, characterized in that the gripper system is one of a pincer gripper system and a transfer gripper system of a turning drum.

12. A method for producing a gripper system for a sheet-guiding drum of a sheet-processing machine, wherein a gripper shaft and a gripper tube are provided, and wherein the gripper tube is composed of joined tube segments, characterized in that gripper elements are allocated to the gripper shaft via recesses in the gripper tube, once the tube segments have been connected to form the gripper tube.

13. The method according to claim 12, characterized in that one of the tube segments of the gripper tube and a tube segment and a connector are connected in one of a materially bonded and a force-fitting connection.

14. The method according to claim 13, characterized in that one of the tube segments of the gripper tube and a tube segment and a connector are connected by one of being pushed together and by one of gluing and shrink fitting.

15. The method according to claim 12, characterized in that the gripper tube is mounted at the connecting points of the tube segments.

* * * * *